US012396612B2

(12) United States Patent
Kim et al.

(10) Patent No.: US 12,396,612 B2
(45) Date of Patent: Aug. 26, 2025

(54) ROBOT VACUUM

(71) Applicant: LG ELECTRONICS INC., Seoul (KR)

(72) Inventors: Youngbin Kim, Seoul (KR); Jaewon Jang, Seoul (KR); Minwoo Lee, Seoul (KR); Yeongjae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 286 days.

(21) Appl. No.: 18/014,799

(22) PCT Filed: Aug. 31, 2020

(86) PCT No.: PCT/KR2020/011621
§ 371 (c)(1),
(2) Date: Jan. 6, 2023

(87) PCT Pub. No.: WO2022/010029
PCT Pub. Date: Jan. 13, 2022

(65) Prior Publication Data

US 2024/0237870 A1 Jul. 18, 2024

(30) Foreign Application Priority Data

Jul. 6, 2020 (KR) ..... 10-2020-0082656

(51) Int. Cl.
*A47L 11/40* (2006.01)

(52) U.S. Cl.
CPC ..... *A47L 11/4069* (2013.01); *A47L 11/4038* (2013.01)

(58) Field of Classification Search
CPC ..... A47L 11/00; A47L 11/02; A47L 11/03; A47L 11/16; A47L 11/24; A47L 11/284;
(Continued)

(56) References Cited

U.S. PATENT DOCUMENTS

2010/0125966 A1 5/2010 Stein et al.
2015/0157181 A1 6/2015 Stuchlik et al.
(Continued)

FOREIGN PATENT DOCUMENTS

KR 10-2019-0099407 A 8/2019
KR 10-2020-0012457 A 2/2020
(Continued)

OTHER PUBLICATIONS

International Search Report dated Apr. 6, 2021 issued in Application PCT/KR2020/011621.
(Continued)

*Primary Examiner* — C. A. Rivera
(74) *Attorney, Agent, or Firm* — KED & ASSOCIATES, LLP

(57) ABSTRACT

The present disclosure relates to a robot cleaner including a coupler provided on a rotary plate to disperse stress generated by a load and stress generated by a rotation, and the robot cleaner includes a rotary plate having a lower portion to which a mop facing a floor is coupled, the rotary plate being rotatably coupled to a body, and a coupler coupled between the body and the rotary plate, thereby preventing damage to the rotary plate by dispersing the stress generated by the load and the stress generated by the rotation.

19 Claims, 15 Drawing Sheets

(58) Field of Classification Search
CPC ..... A47L 11/4036; A47L 11/4038; A47L 11/4063; A47L 11/4069; A47L 2201/00; A47L 2201/06; B24B 7/186; B24D 9/08
See application file for complete search history.

(56) References Cited

U.S. PATENT DOCUMENTS

| | | | |
|---|---|---|---|
| 2019/0328201 | A1 | 10/2019 | Shin et al. |
| 2020/0029763 | A1 | 1/2020 | Song et al. |
| 2020/0077858 | A1 | 3/2020 | Zhang et al. |

FOREIGN PATENT DOCUMENTS

| | | |
|---|---|---|
| KR | 10-2020-0013535 A | 2/2020 |
| WO | WO 2019/143172 | 7/2019 |
| WO | WO 2020/052479 | 3/2020 |

OTHER PUBLICATIONS

Extended European Search Report dated May 8, 2024 issued in Application No. 20944210.2.

(a)

(b)

ROBOT VACUUM

CROSS-REFERENCE TO RELATED PATENT APPLICATIONS

This application is a U.S. National Stage Application under 35 U.S.C. § 371 of PCT Application No. PCT/KR2021/011621, filed Aug. 31, 2020, which claims priority to Korean Patent Application No. 10-2020-0082656, filed Jul. 6, 2020, whose entire disclosures are hereby incorporated by reference.

TECHNICAL FIELD

The present disclosure relates to a robot cleaner, and more particularly, to a robot cleaner in which a coupler capable of dispersing stress generated by a load and stress generated by a rotation is disposed between a body and a rotary plate.

BACKGROUND ART

Recently, a robot cleaner has been developed which performs a cleaning operation while autonomously moving in a zone required to be cleaned without a user's manipulation. Such a robot cleaner in the related art has a sensor capable of recognizing a space to be cleaned, and a mop capable of cleaning a floor surface, such that the robot cleaner may move while wiping and cleaning, with the mop, the floor surface in the space recognized by the sensor.

Among the robot cleaners, there is a wet robot cleaner capable of wiping a floor surface with a mop containing moisture in order to effectively remove foreign substances strongly attached to the floor surface.

Korean Patent No. 10-1903022 discloses a robot cleaner having a first cleaning module including a left spinning mop and a right spinning mop which are in rotational contact with a floor surface and moves the robot cleaner, and a second cleaning module disposed in front of the first cleaning module.

In the robot cleaner in the related art, the first cleaning module and the second cleaning module are inclined downward to the left and right, such that the robot cleaner may move forward or rearward by the rotations of the cleaning modules.

However, the robot cleaner in the related art has a problem in that excessive stress is concentrated on the cleaning module by a vertical drag force applied at a contact point with the floor surface, and the robot cleaner is easily damaged.

DISCLOSURE

Technical Problem

The present disclosure has been made in an effort to solve the above-mentioned problems of the robot cleaner in the related art, and an object of the present disclosure is to provide a robot cleaner in which a coupler disposed between a body and a rotary plate disperses stress generated by a load and stress generated by a rotation, thereby preventing damage to the rotary plate.

Technical Solution

In order to achieve the above-mentioned objects, a robot cleaner according to the present invention may include: a body configured to define an external appearance and including a drive motor; a rotary plate having a lower portion to which a mop facing a floor is coupled, the rotary plate being rotatably coupled to the body; and a coupler coupled between the body and the rotary plate, in which the rotary plate may include: a central plate coupled to the body; a plurality of spokes radially provided along an outer circumferential surface of the central plate; an outer peripheral plate connected to the plurality of spokes and extending by a predetermined width; and a rotary shaft having one side coupled to the drive motor and the other side coupled to the central plate and configured to rotate the central plate, and in which the coupler may include: a coupling portion having a space penetrated by the rotary shaft; and support portions extending by a predetermined length outward in a radial direction from an outer circumferential surface of the coupling portion.

The support portions may extend radially to correspond to the spokes.

The support portion may include: a first support end extending from the outer circumferential surface of the coupling portion and configured to be in contact with an upper portion of the central plate; and a second support end connected to an outer end of the first support end, and the second support end may be disposed to have a level difference from the first support end.

The support portion may include a blade portion extending from an outer end of the second support end, and the blade portion may protrude from the second support end by a predetermined angle so as to support a protruding projection of the central plate.

The second support end may be inclined downward from the first support end.

The support portions may be provided in the form of a plurality of flat plates each having a width that decreases outward in the radial direction.

The coupler may further include a close-contact portion extending by a predetermined length downward from an inner end that defines an internal space of the coupling portion.

The close-contact portion may be in surface contact with an outer circumferential surface of the rotary shaft.

The close-contact portion may include a plurality of flat springs extending downward.

The plurality of flat springs of the close-contact portion may be disposed to be spaced apart from one another at predetermined intervals.

Advantageous Effect

First, according to the robot cleaner according to the present disclosure described above, the coupler is provided between the body and the rotary plate and disperses the stress generated by the load and the stress generated by the rotation, thereby preventing damage to the rotary plate.

Second, the close contact between the rotary shaft and the central plate is maintained by the shape characteristics of the close-contact portion and the support portions of the coupler, thereby mitigating the movement of the rotary plate.

MODE FOR INVENTION

Figure 1:
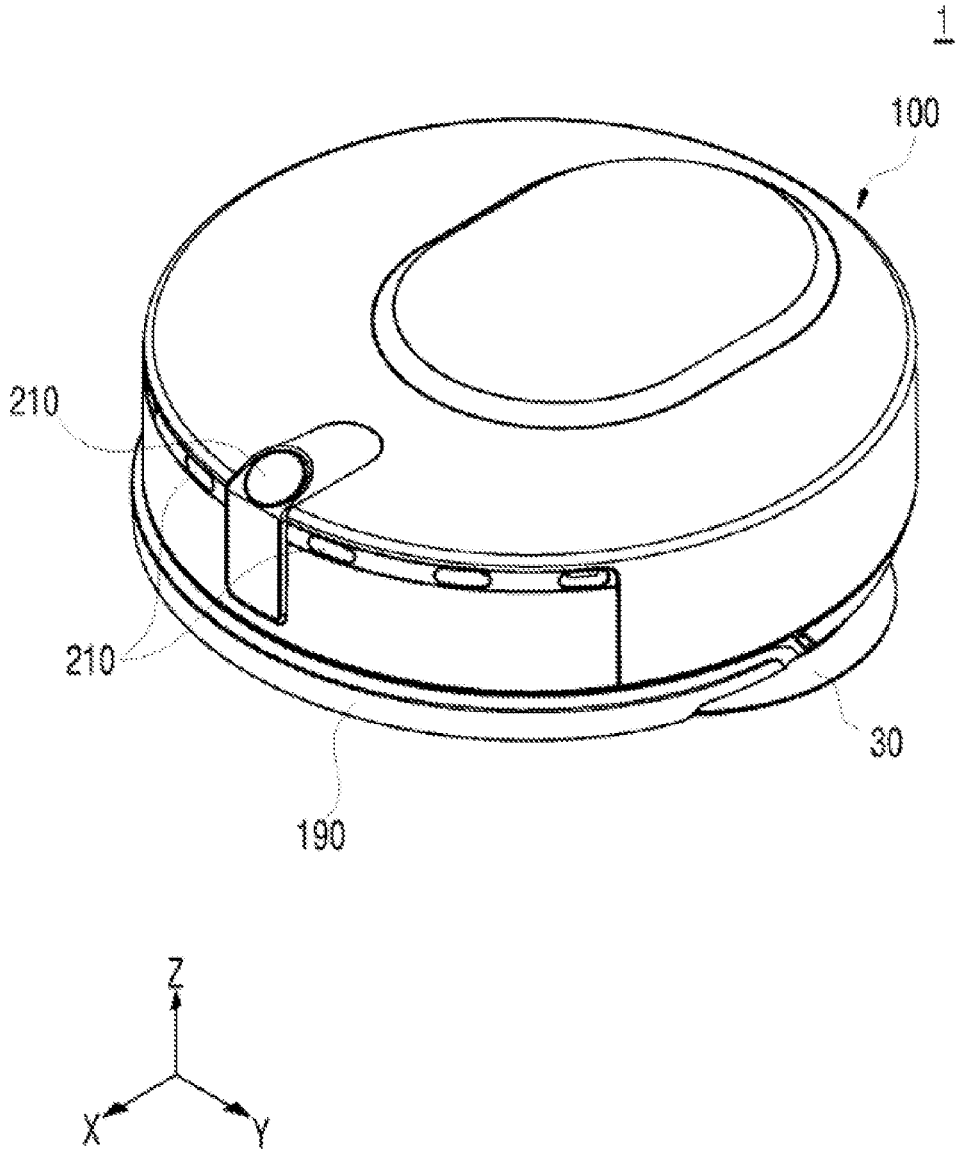
FIG. 1 is a perspective view illustrating a robot cleaner according to an embodiment of the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various components, but the components should not be limited by the terms. These terms are used only to distinguish one component from another component. For example, a first component may be named a second component, and similarly, the second component may also be named the first component, without departing from the scope of the present disclosure.

The term "and/or" includes any and all combinations of a plurality of the related and listed items.

When one component is described as being "coupled" or "connected" to another component, it should be understood that one component can be coupled or connected directly to another component, and an intervening component can also be present between the components. When one component is described as being "coupled directly to" or "connected directly to" another component, it should be understood that no intervening component is present between the components.

The terms used herein is used for the purpose of describing particular embodiments only and is not intended to limit the present disclosure. Singular expressions include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

Figure 2:
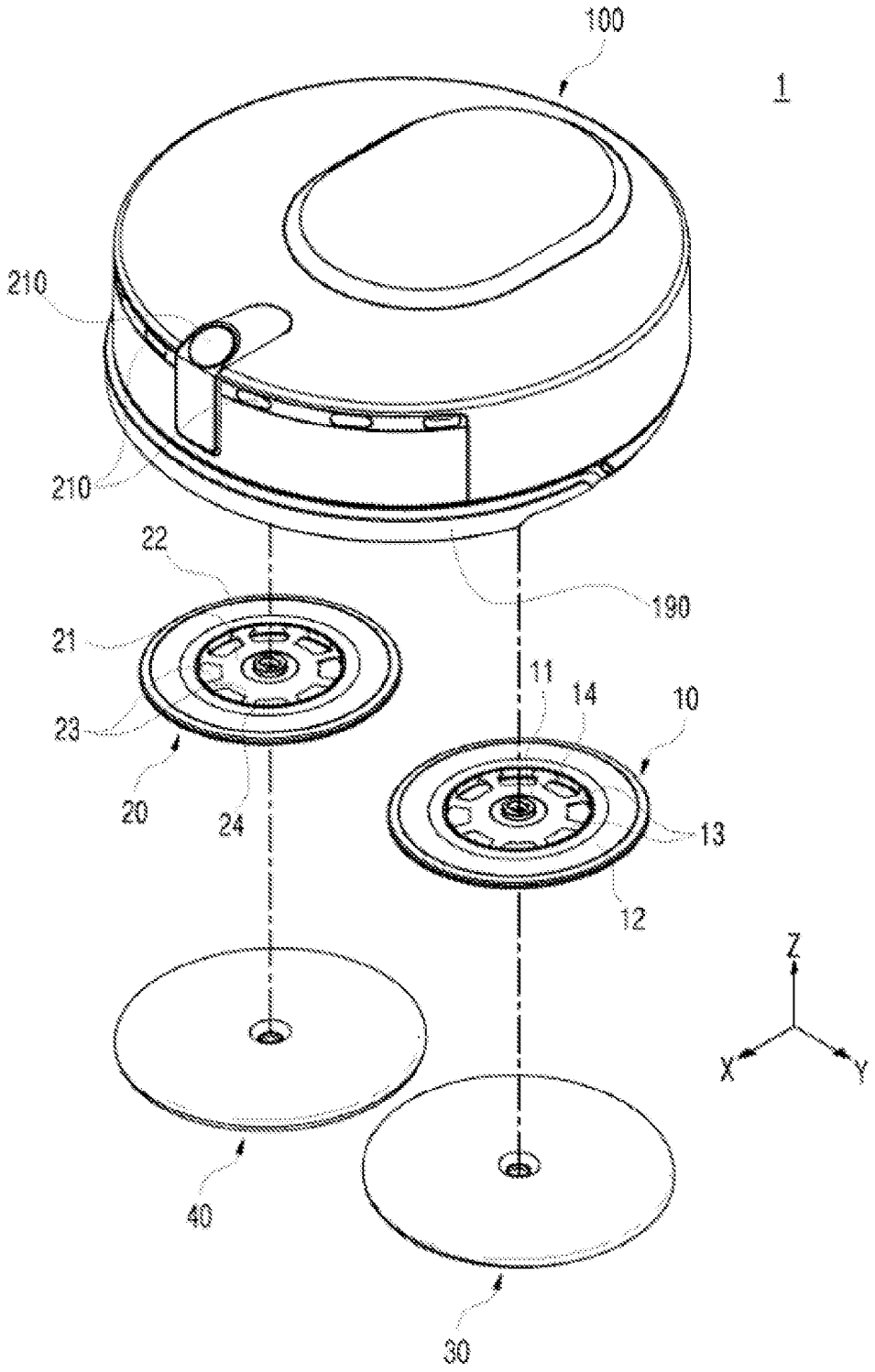
FIG. 2 is a view illustrating some components separated from the robot cleaner according to the embodiment of the present disclosure.
Figure 3:
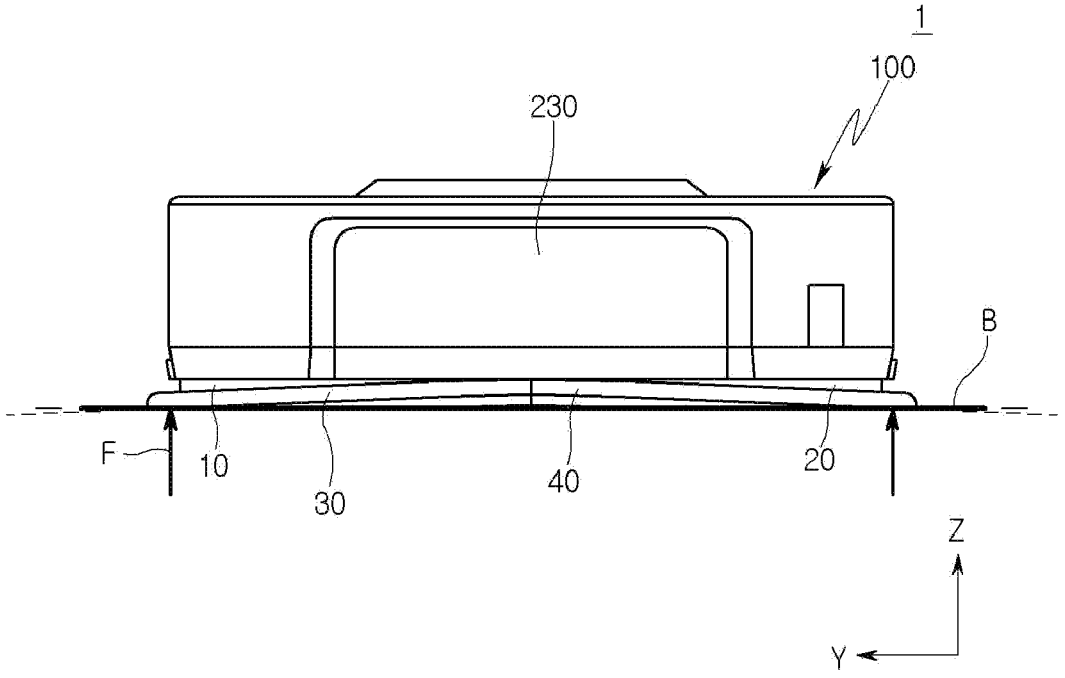
FIG. 3 is a rear view illustrating the robot cleaner according to the embodiment of the present disclosure.
Figure 4:
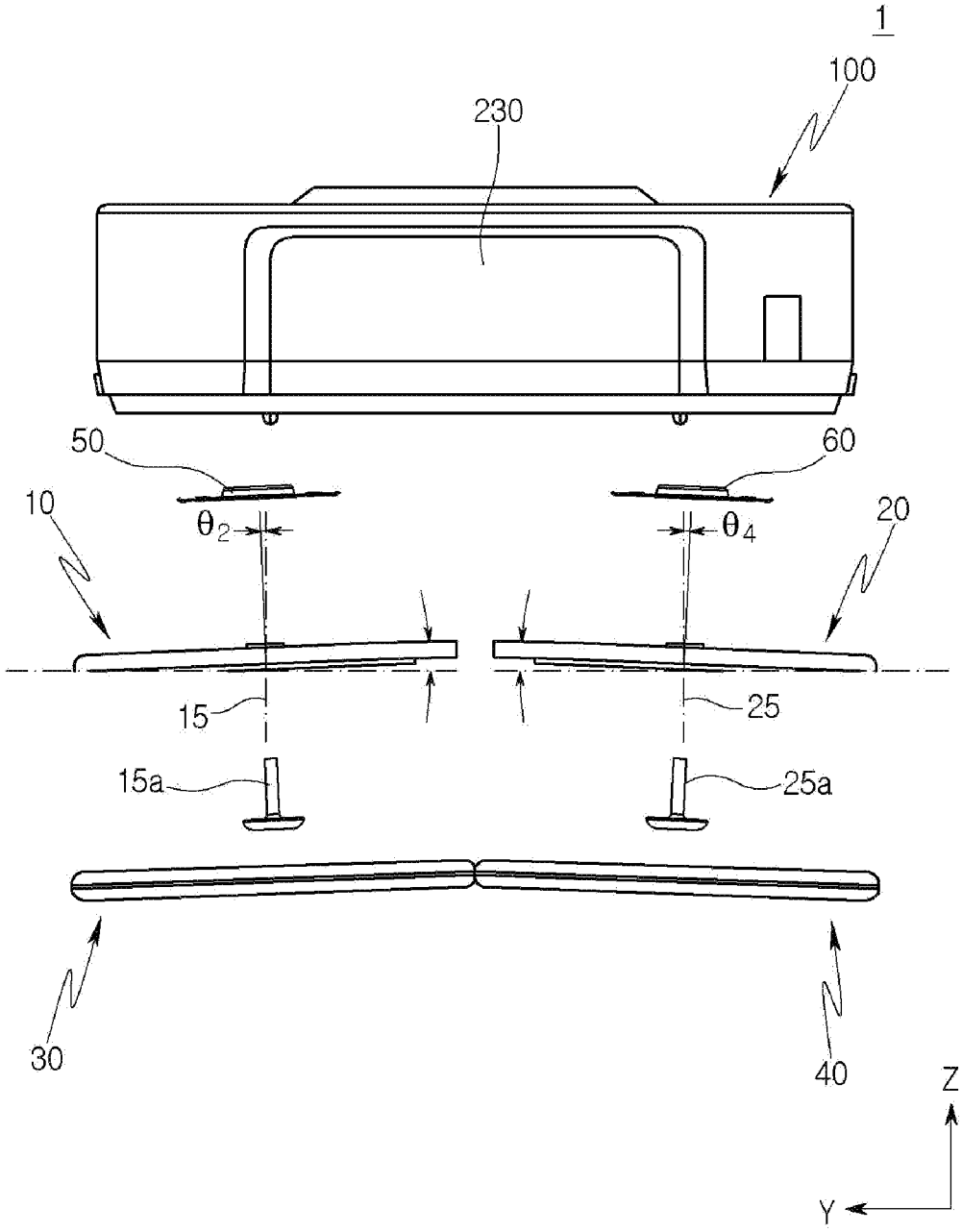
FIG. 4 is a view illustrating some components separated from the robot cleaner illustrated in FIG. 3.
Figure 5:
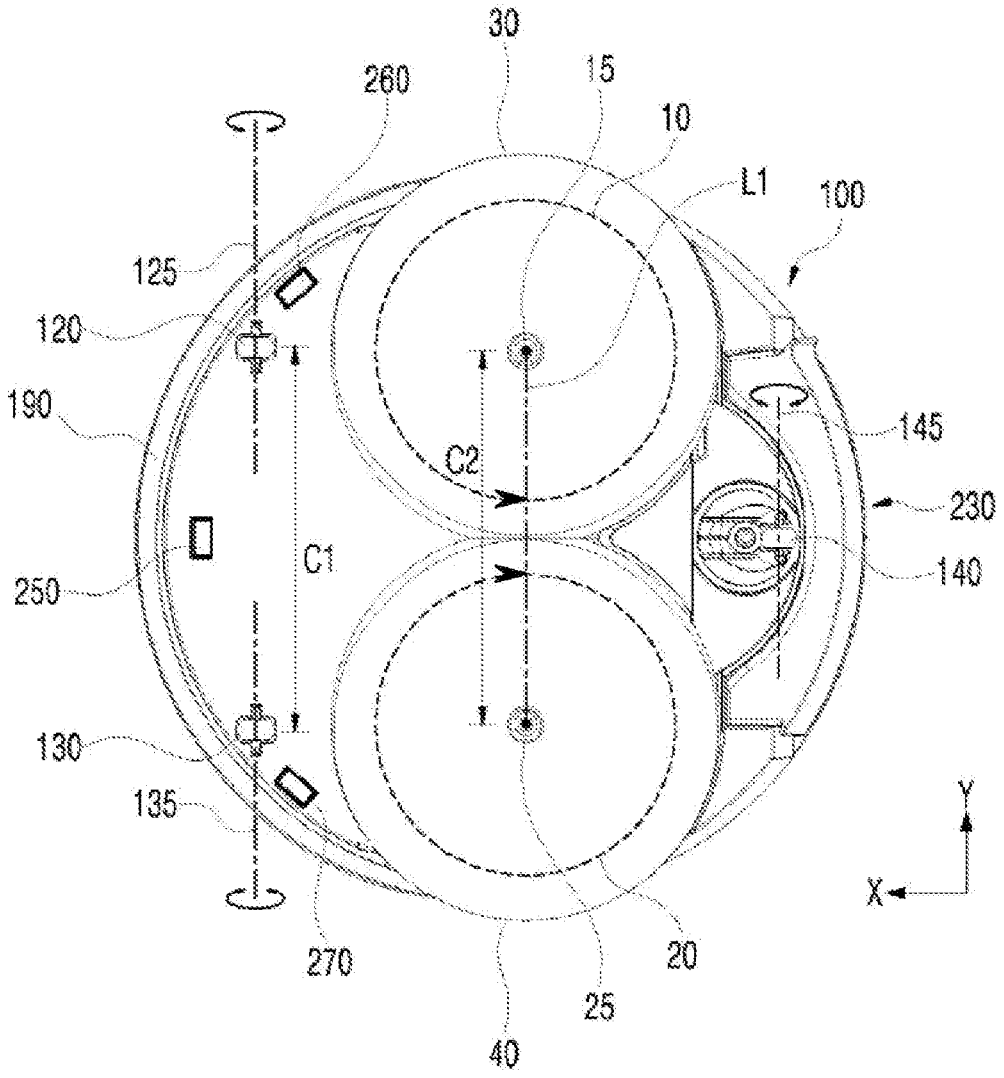
FIG. 5 is a bottom plan view illustrating the robot cleaner according to the embodiment of the present disclosure when viewed from below.
Figure 6:
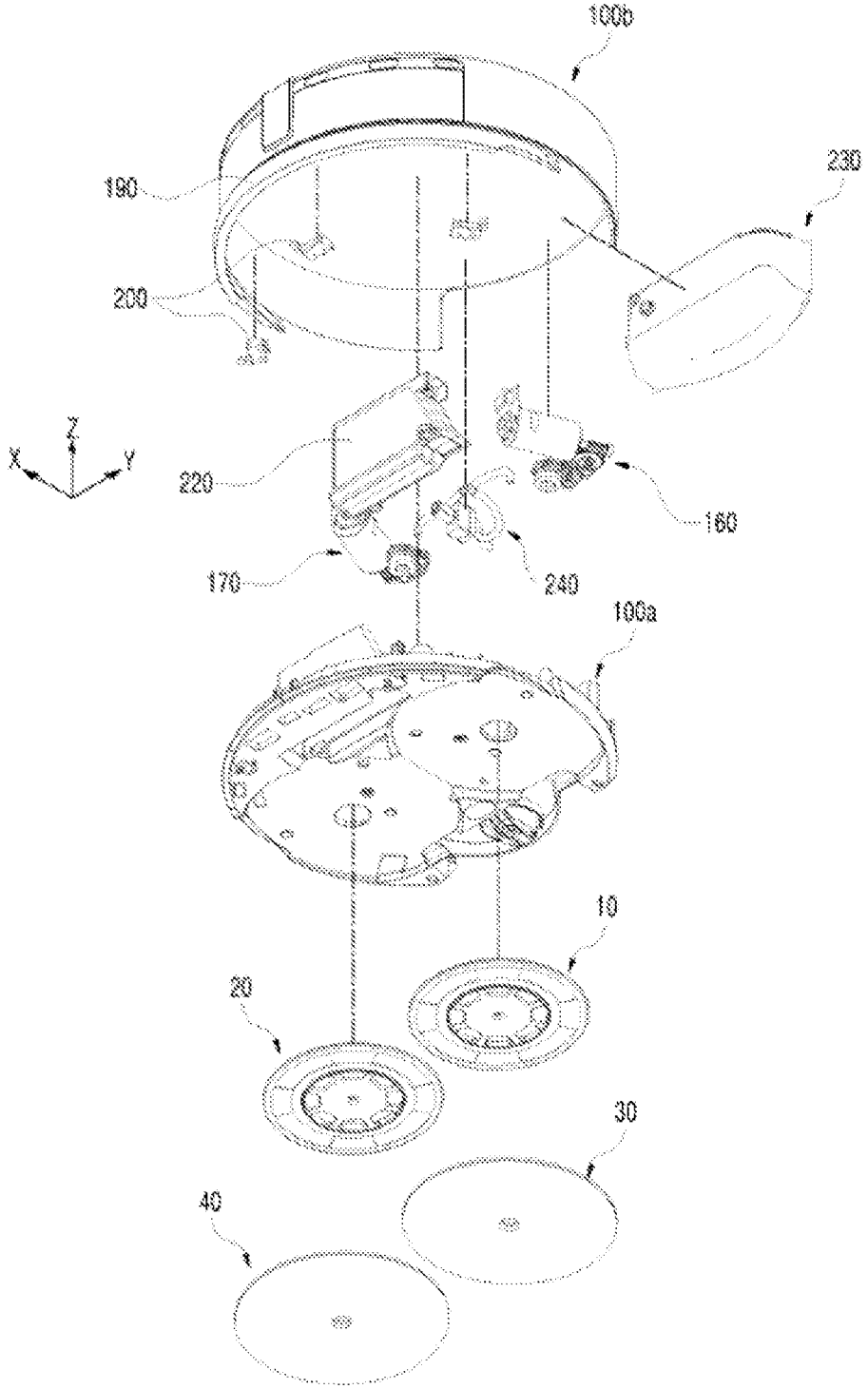
FIG. 6 is an exploded perspective view illustrating the robot cleaner according to the embodiment of the present disclosure.

FIG. 1 is a perspective view illustrating a robot cleaner 1 according to an embodiment of the present disclosure, FIG. 2 is a view illustrating some components separated from the robot cleaner 1 illustrated in FIG. 1, FIG. 3 is a rear view illustrating the robot cleaner 1 illustrated in FIG. 1, FIG. 4 is a view illustrating some components separated from the robot cleaner 1 illustrated in FIG. 3, FIG. 5 is a bottom plan view illustrating the robot cleaner 1 according to the embodiment of the present disclosure, and FIG. 6 is an exploded perspective view illustrating the robot cleaner 1.

The robot cleaner 1 according to the embodiment of the present disclosure is configured to be placed on a floor and clean the floor while moving on a floor surface B. Therefore, hereinafter, a vertical direction is defined based on a state in which the robot cleaner 1 is placed on the floor.

Further, a side at which first and second support wheels 120 and 130 to be described below are coupled is defined as a front side based on a first rotary plate 10 and a second rotary plate 20.

Among the portions described in the embodiment of the present disclosure, a 'lowermost portion' may be a portion positioned at a lowest position or a portion closest to the floor when the robot cleaner 1 according to the embodiment of the present disclosure is placed on the floor and used.

The robot cleaner 1 according to the embodiment of the present disclosure includes a body 100, a first rotary plate 10, a second rotary plate 20, a first mop 30, and a second mop 40.

The body 100 may define an entire external shape of the robot cleaner 1 or may be provided in the form of a frame.

Components constituting the robot cleaner 1 may be coupled to the body 100, and some of the components constituting the robot cleaner 1 may be accommodated in the body 100. The body 100 may be divided into a lower body 100*a* and an upper body 100*b*. The components of the robot cleaner 1 may be provided in a space defined by coupling the lower body 100*a* and the upper body 100*b* (see FIG. 6).

In the embodiment of the present disclosure, a width (or a diameter) in a horizontal direction (i.e., a direction parallel to an X-axis and a Y-axis) of the body 100 may be larger than a height in a vertical direction (i.e., a direction parallel to a Z-axis) of the body 100. The body 100 may provide an advantageous structure that assists the robot cleaner 1 in having a stable structure and allows the robot cleaner 1 to avoid an obstacle while moving traveling.

The body 100 may have various shapes such as a circular shape, an elliptical shape, or a quadrangular shape when viewed from above or below.

The first rotary plate 10 has a predetermined area and is provided in the form of a flat plate, a flat frame, or the like. The first rotary plate 10 is laid approximately horizontally, such that a width (or a diameter) in the horizontal direction is sufficiently larger than a height in the vertical direction thereof. The first rotary plate 10 coupled to the body 100 may be parallel to the floor surface B or inclined with respect to the floor surface B.

The first rotary plate 10 may be provided in the form of a circular plate, a bottom surface of the first rotary plate 10 may be approximately circular.

The first rotary plate 10 may entirely have a rotationally symmetrical shape.

The first rotary plate 10 may include a first central plate 11, a first outer peripheral plate 12, and first spokes 13.

The first central plate 11 defines a center of the first rotary plate 10 and is rotatably coupled to the body 100. The first central plate 11 may be coupled to the lower portion of the body 100. The first central plate 11 may be coupled to the body 100 in such a way that an upper surface of the first central plate 11 is directed toward the bottom surface of the body 100.

A rotary shaft 15 of the first rotary plate 10 may be provided in a direction that penetrates the center of the first central plate 11. In addition, the rotary shaft 15 of the first rotary plate 10 may be provided in a direction orthogonal to the floor surface B or inclined at a predetermined angle with respect to the direction orthogonal to the floor surface B.

The first outer peripheral plate 12 is spaced apart from the first central plate 11 and disposed to surround the first central plate 11.

The first spokes 13 connect the first central plate 11 and the first outer peripheral plate 12. The first spokes 13 are provided in plural and repeatedly disposed in a circumferential direction of the first central plate 11. The first spokes 13 may be arranged at an equal interval. A plurality of holes 14 penetratively formed in the vertical direction is provided between the first spokes 13, and a liquid (e.g., water) discharged from a water supply tube 240 to be described below may be delivered to the first mop 30 through the holes 14.

In the robot cleaner 1 according to the embodiment of the present disclosure, the bottom surface of the first rotary plate 10 coupled to the body 100 may be inclined at a predetermined angle with respect to the floor surface B. In this case, the rotary shaft 15 of the first rotary plate 10 may be inclined at a predetermined angle with respect to the direction perpendicular to the floor surface B.

In the robot cleaner 1 according to the embodiment of the present disclosure, an angle θ1 defined between the bottom surface of the first rotary plate 10 and the floor surface B may be equal to an angle θ2 defined between the rotary shaft 15 of the first rotary plate 10 and the direction perpendicular to the floor surface B. Therefore, the bottom surface of the first rotary plate 10 may maintain the same angle with respect to the floor surface B when the first rotary plate 10 rotates relative to the body 100.

The second rotary plate 20 has a predetermined area and is provided in the form of a flat plate, a flat frame, or the like. The second rotary plate 20 is laid approximately horizontally, such that a width (or a diameter) in the horizontal direction is sufficiently larger than a height in the vertical direction thereof. The second rotary plate 20 coupled to the body 100 may be parallel to the floor surface B or inclined with respect to the floor surface B.

The second rotary plate 20 may be provided in the form of a circular plate, a bottom surface of the second rotary plate 20 may be approximately circular.

The second rotary plate 20 may entirely have a rotationally symmetrical shape.

The second rotary plate 20 may include a second central plate 21, a second outer peripheral plate 22, and second spokes 23.

The second central plate 21 defines a center of the second rotary plate 20 and is rotatably coupled to the body 100. The second central plate 21 may be coupled to the lower portion of the body 100. The second central plate 21 may be coupled to the body 100 in such a way that an upper surface of the second central plate 21 is directed toward the bottom surface of the body 100.

A rotary shaft 25 of the second rotary plate 20 may be provided in a direction that penetrates the center of the second central plate 21. In addition, the rotary shaft 25 of the second rotary plate 20 may be provided in a direction orthogonal to the floor surface B or inclined at a predetermined angle with respect to the direction orthogonal to the floor surface B.

The second outer peripheral plate 22 is spaced apart from the second central plate 21 and disposed to surround the second central plate 21.

The second spokes 23 connect the second central plate 21 and the second outer peripheral plate 22. The second spokes 23 are provided in plural and repeatedly disposed in a circumferential direction of the second central plate 21. The second spokes 23 may be arranged at an equal interval. A plurality of holes 24 penetratively formed in the vertical direction is provided between the second spokes 23, and a liquid (e.g., water) discharged from the water supply tube 240 to be described below may be delivered to the second mop 40 through the holes 24.

In the robot cleaner 1 according to the embodiment of the present disclosure, the bottom surface of the second rotary plate 20 coupled to the body 100 may be inclined at a predetermined angle with respect to the floor surface B. In this case, the rotary shaft 25 of the second rotary plate 20 may be inclined at a predetermined angle with respect to the direction perpendicular to the floor surface B.

In the robot cleaner 1 according to the embodiment of the present disclosure, an angle θ3 defined between the bottom surface of the second rotary plate 20 and the floor surface B may be equal to an angle θ4 defined between the rotary shaft 25 of the second rotary plate 20 and the direction perpendicular to the floor surface B. Therefore, the bottom surface of the second rotary plate 20 may maintain the same angle with respect to the floor surface B when the second rotary plate 20 rotates relative to the body 100.

In the robot cleaner 1 according to the embodiment of the present disclosure, the second rotary plate 20 may be identical to the first rotary plate 10 or the second rotary plate 20 and the first rotary plate 10 may be provided symmetrically. When the first rotary plate 10 is positioned at a left side of the robot cleaner 1, the second rotary plate 20 may be positioned at a right side of the robot cleaner 1. In this case, the first rotary plate 10 and the second rotary plate 20 may be vertically symmetric.

A bottom surface of the first mop 30, which is directed toward the floor, has a predetermined area, and the first mop 30 has a flat shape. The first mop 30 is configured such that a width (or a diameter) in the horizontal direction thereof is sufficiently larger than a height in the vertical direction thereof. When the first mop 30 is coupled to the body 100, the bottom surface of the first mop 30 may be parallel to the floor surface B or inclined with respect to the floor surface B.

The bottom surface of the first mop 30 may be approximately circular.

The first mop 30 may entirely have a rotationally symmetrical shape.

The first mop 30 may be made of various materials capable of wiping the floor while being in contact with the floor. To this end, the bottom surface of the first mop 30 may have a woven fabric, a knitted fabric, a non-woven fabric, and/or a brush having a predetermined area.

In the robot cleaner 1 according to the embodiment of the present disclosure, the first mop 30 is attached to or detached from the bottom surface of the first rotary plate 10. The first mop 30 is coupled to the first rotary plate 10 and rotates together with the first rotary plate 10. The first mop 30 may be coupled to and in close contact with a bottom surface of the first outer peripheral plate 12 or coupled to and in close contact with a bottom surface of the first central plate 11 and the bottom surface of the first outer peripheral plate 12.

The first mop 30 may be attached to or detached from the first rotary plate 10 by various devices and various methods. As an embodiment, at least a part of the first mop 30 may be coupled to the first rotary plate 10 by being caught by or fitted with the first rotary plate 10. As another embodiment, a separate device such as a clamp may be provided to couple the first mop 30 and the first rotary plate 10. As still another embodiment, a pair of fastening devices (specific examples of the fastening devices include a pair of magnets configured to apply attractive forces to each other, a pair of Velcro fasteners configured to be coupled to each other, a pair of buttons (a female button and a male button) configured to be coupled to each other, or the like), which is configured to be coupled to or separated from each other, may be provided. One fastening device may be fixed to the first mop 30, and the other fastening device may be fixed to the first rotary plate 10.

When the first mop 30 is coupled to the first rotary plate 10, the first mop 30 and the first rotary plate 10 may be coupled to each other so as to overlap each other. Alternatively, the first mop 30 and the first rotary plate 10 may be coupled to each other in such a way that a center of the first mop 30 is coincident with a center of the first rotary plate 10.

A bottom surface of the second mop 40, which is directed toward the floor, has a predetermined area, and the second mop 40 has a flat shape. The second mop 40 is configured such that a width (or a diameter) in the horizontal direction thereof is sufficiently larger than a height in the vertical direction thereof. When the second mop 40 is coupled to the body 100, the bottom surface of the second mop 40 may be parallel to the floor surface B or inclined with respect to the floor surface B.

The bottom surface of the second mop 40 may be approximately circular.

The second mop 40 may entirely have a rotationally symmetrical shape.

The second mop 40 may be made of various materials capable of wiping the floor while being in contact with the floor. To this end, the bottom surface of the second mop 40 may have a woven fabric, a knitted fabric, a non-woven fabric, and/or a brush having a predetermined area.

In the robot cleaner 1 according to the embodiment of the present disclosure, the second mop 40 is attached to or detached from the bottom surface of the second rotary plate 20. The second mop 40 is coupled to the second rotary plate 20 and rotates together with the second rotary plate 20. The second mop 40 may be coupled to and in close contact with a bottom surface of the second outer peripheral plate 22 or coupled to and in close contact with a bottom surface of the second central plate 21 and the bottom surface of the second outer peripheral plate 22.

The second mop 40 may be attached to or detached from the second rotary plate 20 by various devices and various methods. As an embodiment, at least a part of the second mop 40 may be coupled to the second rotary plate 20 by being caught by or fitted with the second rotary plate 20. As another embodiment, a separate device such as a clamp may be provided to couple the second mop 40 and the second rotary plate 20. As still another embodiment, a pair of fastening devices (specific examples of the fastening devices include a pair of magnets configured to apply attractive forces to each other, a pair of Velcro fasteners configured to be coupled to each other, a pair of buttons (a female button and a male button) configured to be coupled to each other, or the like), which is configured to be coupled to or separated from each other, may be provided. One fastening device may be fixed to the second mop 40, and the other fastening device may be fixed to the second rotary plate 20.

When the second mop 40 is coupled to the second rotary plate 20, the second mop 40 and the second rotary plate 20 may be coupled to each other so as to overlap each other. Alternatively, the second mop 40 and the second rotary plate 20 may be coupled to each other in such a way that a center of the second mop 40 is coincident with a center of the second rotary plate 20.

The robot cleaner 1 according to the embodiment of the present disclosure may rectilinearly move along the floor surface B. For example, the robot cleaner 1 may rectilinearly move forward (in the X-axis direction) while performing the cleaning operation and may rectilinearly move rearward to avoid an obstacle or a cliff.

In the robot cleaner 1 according to the embodiment of the present disclosure, the first rotary plate 10 and the second rotary plate 20 may be inclined with respect to the floor surface B so that portions of the first and second rotary plates 10 and 20, which are close to each other, are further spaced apart from the floor surface B than portions of the first and second rotary plates 10 and 20, which are distant from each other. That is, the first rotary plate 10 and the second rotary plate 20 are configured such that portions of the first and second rotary plates 10 and 20, which are distant from the center of the robot cleaner 1, are closer to the floor than portions of the first and second rotary plates 10 and 20, which are close to the center of the robot cleaner 1 (see FIGS. 3 and 4).

In addition, the first rotary plate 10 may be coupled to the rotary shaft 15 together with a first coupler 50 disposed above the first rotary plate 10, and the second rotary plate 20 may be coupled to the rotary shaft 25 together with a second coupler 60 disposed above the second rotary plate 20. Specific structures and shapes of the first and second couplers 50 and 60 will be described below in detail with reference to FIG. 8 and the following drawings.

In this case, the rotary shaft 15 of the first rotary plate 10 may be disposed to be perpendicular to the bottom surface of the first rotary plate 10, and the rotary shaft 25 of the second rotary plate 20 may be perpendicular to the bottom surface of the second rotary plate 20.

When the first mop 30 is coupled to the first rotary plate 10 and the second mop 40 is coupled to the second rotary plate 20, the portions of the first and second mops 30 and 40, which are distant from each other, are more strongly in contact with the floor.

The frictional force is generated between the floor surface B and the bottom surface of the first mop 30 when the first rotary plate 10 rotates. In this case, a point at which the frictional force is generated and a direction in which the frictional force is generated deviate from the rotary shaft 15 of the first rotary plate 10, such that the first rotary plate 10 moves relative to the floor surface B. Further, the robot cleaner 1 may move along the floor surface B.

In addition, the frictional force is generated between the floor surface B and the bottom surface of the second mop 40 when the second rotary plate 20 rotates. In this case, a point at which the frictional force is generated and a direction in which the frictional force is generated deviate from the rotary shaft 25 of the second rotary plate 20, such that the second rotary plate 20 moves relative to the floor surface B. Further, the robot cleaner 1 may move along the floor surface B.

When the first rotary plate 10 and the second rotary plate 20 rotate in opposite directions at the same velocity, the robot cleaner 1 may move forward or rearward in a straight direction. For example, when the first rotary plate 10 rotates counterclockwise and the second rotary plate 20 rotates clockwise when viewed from above, the robot cleaner 1 may move forward.

When only any one of the first rotary plate 10 and the second rotary plate 20 rotates, the robot cleaner 1 may change the direction thereof and turn.

When a rotational velocity of the first rotary plate 10 and a rotational velocity of the second rotary plate 20 are different from each other or the first rotary plate 10 and the second rotary plate 20 rotate in the same direction, the robot cleaner 1 may move while changing the direction thereof and move in a curved direction.

The robot cleaner 1 according to the embodiment of the present disclosure includes a first support wheel 120, a second support wheel 130, and a first lower sensor 250.

The first support wheel 120 and the second support wheel 130 may be configured to be in contact with the floor together with the first mop 30 and the second mop 40.

The first support wheel 120 and the second support wheel 130 are spaced apart from each other and may each be provided in the form of a typical wheel. The first support wheel 120 and the second support wheel 130 may be in contact with the floor and move while rolling. Therefore, the robot cleaner 1 may move along the floor surface B.

The first support wheel 120 may be coupled to the bottom surface of the body 100 at a point at which the first rotary plate 10 and the second rotary plate 20 are spaced apart from each other. The second support wheel 130 may also be coupled to the bottom surface of the body 100 at the point at which the first rotary plate 10 and the second rotary plate 20 are spaced apart from each other.

When an imaginary line connecting the center of the first rotary plate 10 and the center of the second rotary plate 20 in the horizontal direction (the direction parallel to the floor surface B) is defined as a connection line L1, the second support wheel 130 and the first support wheel 120 are positioned at the same side based on the connection line L1. In this case, an auxiliary wheel 140 to be described below and the first support wheel 120 are positioned at different sides based on the connection line L1.

An interval between the first support wheel 120 and the second support wheel 130 may be comparatively large in consideration of an overall size of the robot cleaner 1. More specifically, the interval between the first support wheel 120 and the second support wheel 130 may be set to the extent that the first support wheel 120 and the second support wheel 130 may support a part of a load of the robot cleaner 1 and the robot cleaner 1 stands without falling down laterally in a state in which the first support wheel 120 and the second support wheel 130 are placed on the floor surface B (a state in which a rotation axis 125 of the first support wheel 120 and a rotation axis 135 of the second support wheel 130 are parallel to the floor surface B).

The first support wheel 120 may be positioned in front of the first rotary plate 10, and the second support wheel 130 may be positioned in front of the second rotary plate 20.

In the robot cleaner 1 according to the embodiment of the present disclosure, an overall center 105 of gravity may be disposed closer to the first mop 30 and the second mop 40 than are the first support wheel 120 and the second support wheel 130. The first mop 30 and the second mop 40 support a greater proportion of the load of the robot cleaner 1 than the first support wheel 120 and the second support wheel 130.

The first lower sensor 250 is provided at the lower side of the body 100 and configured to detect a relative distance to the floor B. The first lower sensor 250 may be variously configured as long as the first lower sensor 250 may detect the relative distance between the floor surface B and the point at which the first lower sensor 250 is provided.

When the relative distance to the floor surface B (a distance in the vertical direction from the floor surface or a distance in the direction inclined with respect to the floor surface), which is detected by the first lower sensor 250, exceeds a predetermined value or exceeds a predetermined range, this may be a case in which the floor surface is rapidly lowered. Therefore, the first lower sensor 250 may detect a cliff.

The first lower sensor 250 may be an optical sensor and include a light-emitting portion for emitting light, and a light-receiving portion for receiving reflected light. The first lower sensor 250 may be an infrared sensor.

The first lower sensor 250 may be referred to as a cliff sensor.

The first lower sensor 250, the first support wheel 120, and the second support wheel 130 are provided at the same side based on the connection line L1.

The first lower sensor 250 is positioned between the first support wheel 120 and the second support wheel 130 in a peripheral direction of the body 100. In the robot cleaner 1, when the first support wheel 120 is positioned at a relatively left side and the second support wheel 130 is positioned at a relatively right side, the first lower sensor 250 is positioned at an approximately intermediate portion.

The first lower sensor 250 is provided forward from the support wheels 120 and 130.

When the first lower sensor 250 is provided on the lower surface of the body 100, the first lower sensor 250 may be provided at a point sufficiently spaced apart from the first rotary plate 10 and the second rotary plate 20 (and a point sufficiently spaced apart from the first mop 30 and the second mop 40) to allow the first lower sensor 250 to quickly detect a cliff positioned in front of the robot cleaner 1 and to prevent the detection of cliff by the first lower sensor 250 from being hindered by the first mop 30 and the second mop 40. Therefore, the first lower sensor 250 is provided adjacent to a rim of the body 100.

The operation of the robot cleaner 1 according to the embodiment of the present disclosure may be controlled based on the distance detected by the first lower sensor 250. More specifically, the rotation of any one of the first rotary plate 10 and the second rotary plate 20 may be controlled based on the distance detected by the first lower sensor 250. For example, when the distance detected by the first lower sensor 250 exceeds a predetermined value or a predetermined range, the rotations of the first and second rotary plates 10 and 20 are stopped such that the robot cleaner 1 may be stopped, or the rotation directions of the first rotary plate 10 and/or the second rotary plate 20 are changed such that the movement direction of the robot cleaner 1 may be changed.

In the embodiment of the present disclosure, a detection direction of the first lower sensor 250 may be inclined downward toward the rim of the body 100. For example, in the case in which the first lower sensor 250 is an optical sensor, a direction of the light emitted from the first lower sensor 250 may not be perpendicular to the floor surface B but inclined forward.

Therefore, the first lower sensor 250 may detect a cliff positioned in front of the first lower sensor 250 and detect a cliff positioned comparatively in front of the body 100, thereby preventing the robot cleaner 1 from reaching the cliff.

The robot cleaner 1 according to the embodiment of the present disclosure may change the direction thereof to the left or right and move in the curved direction while performing the cleaning operation. In this case, the first mop 30, the second mop 40, the first support wheel 120, and the second support wheel 130 are in contact with the floor and support the load of the robot cleaner 1.

When the robot cleaner 1 moves while changing the direction thereof to the left, the first lower sensor 250 may detect a cliff F before the first support wheel 120 and the second support wheel 130 reach the cliff F, and the first lower sensor 250 may detect the cliff F before the second support wheel 130 at least reaches the cliff F. The load of the robot cleaner 1 is supported by the first mop 30, the second mop 40, the first support wheel 120, and the second support wheel 130 or supported at least by the first mop 30, the second mop 40, and the second support wheel 130 while the first lower sensor 250 detects the cliff F.

When the robot cleaner 1 moves while rotating to the right, the first lower sensor 250 may detect the cliff F before the first support wheel 120 and the second support wheel 130 reach the cliff F, and the first lower sensor 250 may detect the cliff F before the first support wheel 120 at least reaches the cliff F. The load of the robot cleaner 1 is supported by the first mop 30, the second mop 40, the first support wheel 120, and the second support wheel 130 or supported at least by the first mop 30, the second mop 40, and the first support wheel 120 while the first lower sensor 250 detects the cliff F.

As described above, according to the robot cleaner 1 according to the embodiment of the present disclosure, the first lower sensor may detect the cliff F before the first support wheel 120 and the second support wheel 130 reach the cliff F not only when the robot cleaner 1 rectilinearly moves but also when the robot cleaner 1 changes the direction thereof. Therefore, it is possible to prevent the robot cleaner 1 from falling from the cliff F and prevent the robot cleaner 1 from losing the overall balance.

The robot cleaner 1 according to the embodiment of the present disclosure includes a second lower sensor 260 and a third lower sensor 270.

The second lower sensor 260 and the third lower sensor 270 are disposed at the same side as the first support wheel 120 and the second support wheel 130 based on the connection line L1 and provided at the lower side of the body 100. The second lower sensor 260 and the third lower sensor 270 are configured to detect relative distances to the floor B.

When the second lower sensor 260 is provided on the lower surface of the body 100, the second lower sensor 260 is spaced apart from the first mop 30 and the second mop 40 to prevent the detection of the cliff F by the second lower sensor 260 from being hindered by the first mop 30 and the second mop 40. In addition, the second lower sensor 260 may be provided at a point spaced apart outward from the first support wheel 120 or the second support wheel 130 in order to quickly detect the cliff F positioned at the left side or the right side of the robot cleaner 1. The second lower sensor 260 may be provided adjacent to the rim of the body 100.

The second lower sensor 260 may be provided at the opposite side to the first lower sensor 250 based on the first support wheel 120. Therefore, the cliff F positioned at one side of the first support wheel 120 may be detected by the first lower sensor 250, and the cliff F positioned at the other side of the first support wheel 120 may be detected by the second lower sensor 260, such that the cliff F positioned at the periphery of the first support wheel 120 may be effectively detected.

When the third lower sensor 270 is provided on the lower surface of the body 100, the third lower sensor 270 is spaced apart from the first mop 30 and the second mop 40 to prevent the detection of the cliff F by the third lower sensor 270 from being hindered by the first mop 30 and the second mop 40. In addition, the third lower sensor 270 may be provided at a point spaced apart outward from the first support wheel 120 or the second support wheel 130 in order to quickly detect the cliff F positioned at the left side or the right side of the robot cleaner 1. The third lower sensor 260 may be provided adjacent to the rim of the body 100.

The third lower sensor 270 may be provided at the opposite side to the first lower sensor 250 based on the second support wheel 130. Therefore, the cliff F positioned at one side of the second support wheel 130 may be detected by the first lower sensor 250, and the cliff F positioned at the other side of the second support wheel 130 may be detected by the third lower sensor 270, such that the cliff F positioned at the periphery of the second support wheel 130 may be effectively detected.

The second lower sensor 260 and the third lower sensor 270 may be variously configured as long as the second lower sensor 260 and the third lower sensor 270 may each detect the relative distance to the floor surface B. The second lower sensor 260 and the third lower sensor 270 may be identical to the first lower sensor 250 except for the positions at which the sensors are provided.

The operation of the robot cleaner 1 according to the embodiment of the present disclosure may be controlled based on the distance detected by the second lower sensor 260. More specifically, the rotation of any one of the first rotary plate 10 and the second rotary plate 20 may be controlled based on the distance detected by the second lower sensor 260. For example, when the distance detected by the second lower sensor 260 exceeds a predetermined value or a predetermined range, the rotations of the first and second rotary plates 10 and 20 are stopped such that the robot cleaner 1 may be stopped, or the rotation directions of the first rotary plate 10 and/or the second rotary plate 20 are changed such that the movement direction of the robot cleaner 1 may be changed.

In addition, the operation of the robot cleaner 1 according to the embodiment of the present disclosure may be controlled based on the distance detected by the third lower sensor 270. More specifically, the rotation of any one of the first rotary plate 10 and the second rotary plate 20 may be controlled based on the distance detected by the third lower sensor 270. For example, when the distance detected by the third lower sensor 270 exceeds a predetermined value or a predetermined range, the rotations of the first and second rotary plates 10 and 20 are stopped such that the robot cleaner 1 may be stopped, or the rotation directions of the first rotary plate 10 and/or the second rotary plate 20 are changed such that the movement direction of the robot cleaner 1 may be changed.

A distance from the connection line L1 to the second lower sensor 260 and a distance from the connection line L1 to the third lower sensor 270 may be shorter than a distance from the connection line L1 to the first support wheel 120 and a distance from the connection line L1 to the second support wheel 130.

In addition, the second lower sensor 260 and the third lower sensor 270 are positioned outside a vertical region of a quadrangle having vertices defined by a center of the first rotary plate 10, a center of the second rotary plate 20, a center of the first support wheel 120, and a center of the second support wheel 130.

When the second lower sensor 260 is positioned at the left side of the robot cleaner 1, the third lower sensor 270 may be positioned at the right side of the robot cleaner 1.

The second lower sensor 260 and the third lower sensor 270 may be symmetric to each other.

The robot cleaner 1 according to the embodiment of the present disclosure may turn. In this case, the first mop 30, the second mop 40, the first support wheel 120, and the second support wheel 130 are in contact with the floor and support the load of the robot cleaner 1.

When the cliff F is positioned at the left side of the robot cleaner 1 and the robot cleaner 1 turns or changes the direction thereof to the left, the second lower sensor 260 may detect the cliff F before the first support wheel 120 and the second support wheel 130 reach the cliff F. The load of the robot cleaner 1 is supported by the first mop 30, the second mop 40, the first support wheel 120, and the second support wheel 130 while the second lower sensor 260 detects the cliff F.

In addition, when the cliff F is positioned at the right side of the robot cleaner 1 and the robot cleaner 1 turns or changes the direction thereof to the right, the third lower sensor 270 may detect the cliff F before the first support wheel 120 and the second support wheel 130 reach the cliff F. The load of the robot cleaner 1 is supported by the first mop 30, the second mop 40, the first support wheel 120, and the second support wheel 130 while the third lower sensor 270 detects the cliff F.

As described above, according to the robot cleaner 1 according to the embodiment of the present disclosure, it is possible to prevent the robot cleaner 1 from falling from the cliff F and prevent the robot cleaner 1 from losing the overall balance when the robot cleaner 1 changes the direction thereof or rotates to one side.

The robot cleaner 1 according to the embodiment of the present disclosure may include the auxiliary wheel 140 together with the first support wheel 120 and the second support wheel 130.

The auxiliary wheel 140 may be coupled to the lower portion of the body 100 and spaced apart from the first rotary plate 10 and the second rotary plate 20.

The auxiliary wheel 140 is positioned at a different side from the first support wheel 120 and the second support wheel 130 based on the connection line L1.

In the embodiment of the present disclosure, the auxiliary wheel 140 may be provided in the form of a typical wheel, and a rotation axis 145 of the auxiliary wheel 140 may be parallel to the floor surface B. The auxiliary wheel 140 may be in contact with the floor and move while rolling. Therefore, the robot cleaner may move along the floor surface B.

However, in the embodiment of the present disclosure, the auxiliary wheel 140 is not in contact with the floor when the first mop 30 and the second mop 40 are in contact with the floor.

Based on the first rotary plate 10 and the second rotary plate 20, the first support wheel 120 and the second support wheel 130 are positioned at the front side, and the auxiliary wheel 140 is positioned at the rear side.

In the robot cleaner 1 according to the embodiment of the present disclosure, the first rotary plate 10 and the second rotary plate 20 may be symmetric (vertically symmetric) to each other, and the first support wheel 120 and the second support wheel 130 may be symmetric (vertically symmetric) to each other.

In the robot cleaner 1 according to the embodiment of the present disclosure, in the state in which the first mop 30 is coupled to the first rotary plate 10 and the second mop 40 is coupled to the second rotary plate 20, the first support wheel 120, the second support wheel 130, and the auxiliary wheel 140 do not hinder the contact between the floor and the first and second mops 30 and 40.

Therefore, the first mop 30 and the second mop 40 are in contact with the floor, such that the mopping and cleaning operation may be performed by the rotations of the first and second mops 30 and 40. In this case, all the first support wheel 120, the second support wheel 130, and the auxiliary wheel 140 may be spaced apart from the floor. Alternately, the auxiliary wheel 140 may be spaced apart from the floor, and the first support wheel 120 and the second support wheel 130 may be in contact with the floor.

In the embodiment of the present disclosure, in the state in which the robot cleaner 1 is placed on the floor so that the first mop 30 and the second mop 40 are in contact with the floor, a height from the floor surface B to the lowest portion of the first support wheel 120 and a height from the floor surface B to the lowest portion of the second support wheel 130 may be smaller than a height from the floor surface B to the lowest portion of the auxiliary wheel 140.

The robot cleaner 1 according to the embodiment of the present disclosure includes a first actuator 160, a second actuator 170, the battery 220, the water container 230, and the water supply tube 240.

The first actuator 160 is coupled to the body 100 and configured to rotate the first rotary plate 10.

The first actuator 160 may include a first casing 161, a first motor 162, and one or more first gears 163.

The first casing 161 is fixedly coupled to the body 100 and supports components constituting the first actuator 160.

The first motor 162 may be an electric motor.

The plurality of first gears 163 meshes with each other and rotates together. The plurality of first gears 163 connects the first motor 162 and the first rotary plate 10 and transmits rotational power from the first motor 162 to the first rotary plate 10. Therefore, the first rotary plate 10 rotates when a rotary shaft of the first motor 162 rotates.

The second actuator 170 is coupled to the body 100 and configured to rotate the second rotary plate 20.

The second actuator 170 may include a second casing 171, a second motor 172, and one or more second gears 173.

The second casing 171 is fixedly coupled to the body 100 and supports components constituting the second actuator 170.

The second motor 172 may be an electric motor.

The plurality of second gears 173 meshes with each other and rotates together. The plurality of second gears 173 connects the second motor 172 and the second rotary plate 20 and transmits rotational power from the second motor 172 to the second rotary plate 20. Therefore, the second rotary plate 20 rotates when a rotary shaft of the second motor 172 rotates.

As described above, in the robot cleaner 1 according to the embodiment of the present disclosure, the first rotary plate 10 and the first mop 30 may be rotated by the operation of the first actuator 160, and the second rotary plate 20 and the second mop 40 may be rotated by the operation of the second actuator 170.

In the embodiment of the present disclosure, the first actuator 160 may be disposed directly on the first rotary plate 10. This configuration may minimize a loss of power transmitted from the first actuator 160 to the first rotary plate 10. In addition, a load of the first actuator 160 may be applied to the first rotary plate 10, such that the first mop 30 may perform the mopping operation while generating sufficient friction with the floor.

In addition, in the embodiment of the present disclosure, the second actuator 170 may be disposed directly on the second rotary plate 20. This configuration may minimize a loss of power transmitted from the second actuator 170 to the second rotary plate 20. In addition, a load of the second actuator 170 may be applied to the second rotary plate 20, such that the second mop 40 may perform the mopping operation while generating sufficient friction with the floor.

The second actuator 170 and the first actuator 160 may be symmetric (vertically symmetric).

The battery 220 is coupled to the body 100 and configured to supply power to the other components constituting the robot cleaner 1. The battery 220 may supply power to the first actuator 160 and the second actuator 170. In particular, the battery 220 supplies power to the first motor 162 and the second motor 172.

In the embodiment of the present disclosure, the battery 220 may be charged with external power. To this end, a charging terminal for charging the battery 220 may be provided at one side of the body 100 or provided on the battery 220.

In the robot cleaner 1 according to the embodiment of the present disclosure, the battery 220 may be coupled to the body 100.

The water container 230 is provided in the form of a container having an internal space that stores therein a liquid such as water. The water container 230 may be fixedly coupled to the body 100 or detachably coupled to the body 100.

In the embodiment of the present disclosure, the water container 230 may be positioned above the auxiliary wheel 140.

The water supply tube 240 is provided in the form of a tube or a pipe and connected to the water container 230 so that the liquid in the water container 230 may flow through the inside of the water supply tube 240. An end of the water supply tube 240, which is opposite to the side at which the water supply tube 240 is connected to the water container 230, is provided above the first rotary plate 10 and the second rotary plate 20, such that the liquid in the water container 230 may be supplied to the first mop 30 and the second mop 40.

In the robot cleaner 1 according to the embodiment of the present disclosure, the water supply tube 240 may be provided in a shape having two tube portions diverged from a single tube portion. In this case, an end of one diverged tube portion may be positioned above the first rotary plate 10, and an end of the other diverged tube portion may be positioned above the second rotary plate 20.

In the robot cleaner 1 according to the embodiment of the present disclosure, a separate pump may be provided to move the liquid through the water supply tube 240.

The center 105 of gravity of the robot cleaner 1 may be positioned in the vertical region of the quadrangle having the vertices defined by the center of the first rotary plate 10, the center of the second rotary plate 20, the center of the first support wheel 120, and the center of the second support wheel 130. Therefore, the robot cleaner 1 is supported by the first mop 30, the second mop 40, the first support wheel 120, and the second support wheel 130.

In the robot cleaner 1 according to the embodiment of the present disclosure, the first actuator 160, the second actuator 170, the battery 220, and the water container 230 may each serve as a comparatively heavyweight member in the robot cleaner 1. Therefore, the overall center 105 of gravity of the robot cleaner 1 may be positioned at the central portion of the robot cleaner 1 as the first actuator 160 and the second actuator 170 are positioned on or adjacent to the connection line, the battery 220 is positioned at the front side of the connection line, and the water container 230 is positioned at the rear side of the connection line. Therefore, the first mop 30 and the second mop 40 may be in stable contact with the floor.

In addition, since the first actuator 160, the second actuator 170, the battery 220, and the water container 230 are positioned in different regions, respectively, in a top plan view, the weight distribution may be stably performed, such that the body 100 and the robot cleaner 1 may become comparatively flat. Therefore, the robot cleaner 1 may be configured to easily enter a lower space of a shelf, a table, or the like.

In addition, according to the robot cleaner 1 according to the embodiment of the present disclosure, the weight distribution may be performed in such a way that only the first mop 30 and the second mop 40 are in contact with the floor and clean the floor when the robot cleaner 1 initially operates with the water container 230 sufficiently filled with the liquid. When the center of gravity of the robot cleaner 1 is moved forward as the liquid in the water container 230 is used, the first mop 30 and the second mop 40, together with the first support wheel 120 and the second support wheel 130, may be in contact with the floor and clean the floor.

In addition, according to the robot cleaner 1 according to the embodiment of the present disclosure, the first support wheel 120 and the second support wheel 130, together with the first mop 30 and the second mop 40, may be in contact with the floor and clean the floor regardless of whether the liquid in the water container 230 is used.

The robot cleaner 1 according to the embodiment of the present disclosure may be configured such that the second lower sensor 260, the first support wheel 120, the first lower sensor 250, the second support wheel 130, and the third lower sensor 270 are arranged in this order in the peripheral direction of the body 100.

Figure 7:
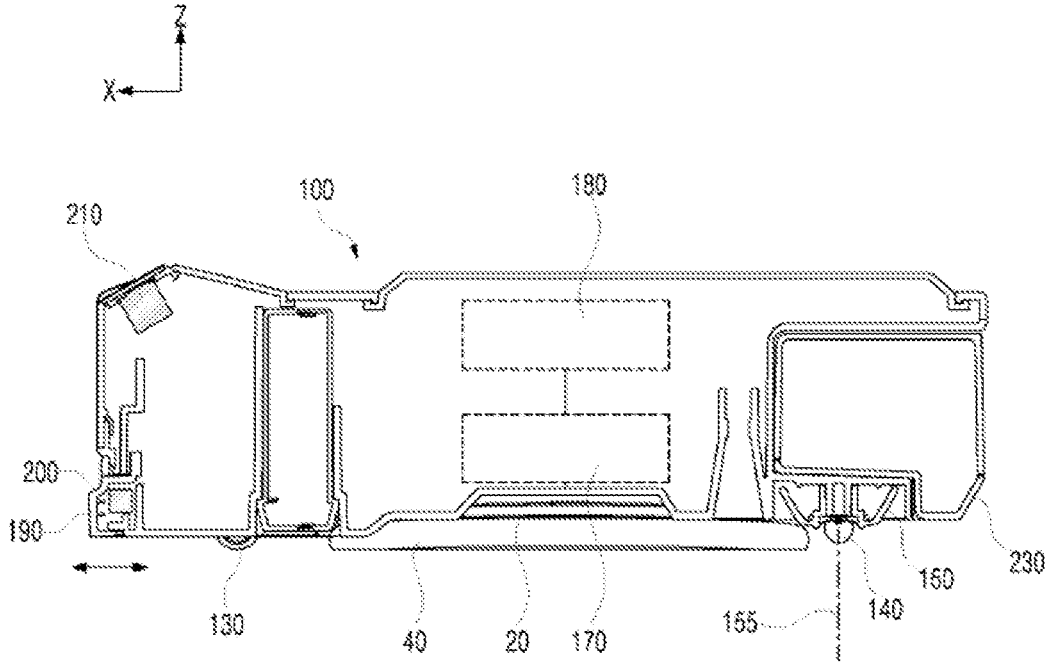
FIG. 7 is a cross-sectional view schematically illustrating a robot cleaner and components of the robot cleaner according to still another embodiment of the present disclosure.

FIG. 7 is a cross-sectional view schematically illustrating the robot cleaner 1 and components of the robot cleaner 1 according to still another embodiment of the present disclosure.

The robot cleaner 1 according to the embodiment of the present disclosure may include a control part 180, a bumper 190, a first sensor 200, and a second sensor 210.

The control part 180 may be configured to control the operations of the first and second actuators 160 and 170 based on preset information or real-time information. The robot cleaner 1 may be provided with a storage medium that stores an application program for the control operation of the control part 180. The control part 180 may be configured to control the robot cleaner 1 by executing the application program based on information inputted to the robot cleaner 1 and information outputted from the robot cleaner 1.

The bumper 190 is coupled along the rim of the body 100 and configured to move relative to the body 100. For example, the bumper 190 may be coupled to the body 100 so as to be reciprocally movable in a direction toward the center of the body 100.

The bumper 190 may be coupled along a part of the rim of the body 100 or coupled along the entire rim of the body 100.

In the robot cleaner according to the embodiment of the present disclosure, the lowest portion of the body 100, which is disposed at the same side as the bumper 190 based on the connection line L1, may be equal to or higher in height than the lowest portion of the bumper 190. That is, the bumper 190 may be equal to or lower in height than the body 100. Therefore, an obstacle positioned at a comparatively low position may collide with the bumper 190, and the bumper 190 may detect the obstacle.

The first sensor 200 may be coupled to the body 100 and configured to detect a motion (relative movement) of the bumper 190 relative to the body 100. The first sensor 200 may be a microswitch, a photo-interrupter, a tact switch, or the like.

When the bumper 190 of the robot cleaner 1 comes into contact with an obstacle, the control part 180 may control the robot cleaner 1 to allow the robot cleaner 1 to avoid the obstacle. The control part 180 may control the operation of the first actuator 160 and/or the second actuator 170 based on information detected by the first sensor 200. For example, when the bumper 190 comes into contact with an obstacle while the robot cleaner 1 moves, the first sensor 120 may recognize a position at which the bumper 190 comes into contact with the obstacle, and the control part 180 may control the operations of the first actuator 160 and/or the second actuator 170 so that the robot cleaner 1 departs from the contact position.

The second sensor 210 may be coupled to the body 100 and configured to detect a relative distance to an obstacle. The second sensor 210 may be a distance sensor.

When a distance between the robot cleaner 1 and the obstacle is a predetermined value or less based on information detected by the second sensor 210, the control part 180 may control the operations of the first actuator 160 and/or the second actuator 170 so that the movement direction of the robot cleaner 1 is changed or the robot cleaner 1 moves away from the obstacle.

In addition, based on a distance detected by the first lower sensor 250, the second lower sensor 260, or the third lower sensor 270, the control part 180 may control the operations of the first actuator 160 and/or the second actuator 170 so that the robot cleaner 1 is stopped or the movement direction is changed.

The robot cleaner 1 according to the embodiment of the present disclosure may move (travel) by means of a frictional force generated between the first mop 30 and the floor surface B when the first rotary plate 10 rotates and a frictional force generated between the second mop 40 and the floor surface B when the second rotary plate 20 rotates.

In the robot cleaner 1 according to the embodiment of the present disclosure, the first support wheel 120 and the second support wheel 130 may be configured so as not to hinder the movement (traveling) of the robot cleaner 1 by the frictional force with the floor. Further, the first support wheel 120 and the second support wheel 130 may be configured so as not to increase a load when the robot cleaner 1 moves (travels).

To this end, a width of the first support wheel 120 and a width of the second support wheel 130 may be sufficiently smaller than a diameter of the first rotary plate 10 or a diameter of the second rotary plate 20.

With the above-mentioned configuration, even though the first support wheel 120 and the second support wheel 130, together with the first mop 30 and the second mop 40, are in contact with the floor and the robot cleaner 1 operates, the frictional force between the first support wheel 120 and the floor surface B and the frictional force between the second support wheel 130 and the floor surface B are significantly lower than the frictional force between the first mop 30 and the floor surface B and the frictional force between the second mop 40 and the floor surface B. Therefore, an unnecessary loss of power does not occur, and the movement of the robot cleaner 1 is not hindered.

The robot cleaner 1 according to the embodiment of the present disclosure may be stably supported at four points by the first support wheel 120, the second support wheel 130, the first mop 30, and the second mop 40.

In the robot cleaner 1 according to the embodiment of the present disclosure, the rotation axis 125 of the first support wheel 120 and the rotation axis 135 of the second support wheel 130 may be parallel to the connection line L1. That is, the rotation axis 125 of the first support wheel 120 and the rotation axis 135 of the second support wheel 130 may be fixed (fixed in a left-right direction) in position on the body 100.

The first support wheel 120 and the second support wheel 130, together with the first mop 30 and the second mop 40, may be in contact with the floor. In this case, in order to rectilinearly move the robot cleaner 1, the first mop 30 and the second mop 40 may rotate in opposite directions at the same velocity, and the first support wheel 120 and the second support wheel 130 assist the forward and rearward rectilinear movements of the robot cleaner 1.

The robot cleaner 1 according to the embodiment of the present disclosure may include an auxiliary wheel body 150. In this case, the auxiliary wheel body 150 is rotatably coupled to the lower portion of the body 100, and the auxiliary wheel 140 is rotatably coupled to the auxiliary wheel body 150.

That is, the auxiliary wheel 140 is connected to the body 100 through the auxiliary wheel body 150.

Further, the rotation axis 145 of the auxiliary wheel 140 and the rotation axis 155 of the auxiliary wheel body 150 may intersect each other, and a direction of the rotation axis 145 of the auxiliary wheel 140 may be orthogonal to a direction of the rotation axis 155 of the auxiliary wheel body 150. For example, a rotation axis 155 of the auxiliary wheel body 150 may extend in the vertical direction or may be slightly inclined with respect to the vertical direction. The rotation axis 145 of the auxiliary wheel 140 may extend in the horizontal direction.

In the robot cleaner 1 according to the embodiment of the present disclosure, the auxiliary wheel 140 is in contact with the floor surface B when the robot cleaner 1 is not substantially used (in a state in which the first mop 30 and the second mop 40 are separated from the robot cleaner 1). When the robot cleaner 1 is intended to be moved in this state, a direction in which the auxiliary wheel 140 is directed is freely changed by the auxiliary wheel body 150, such that the robot cleaner 1 may be easily moved.

Figure 8:
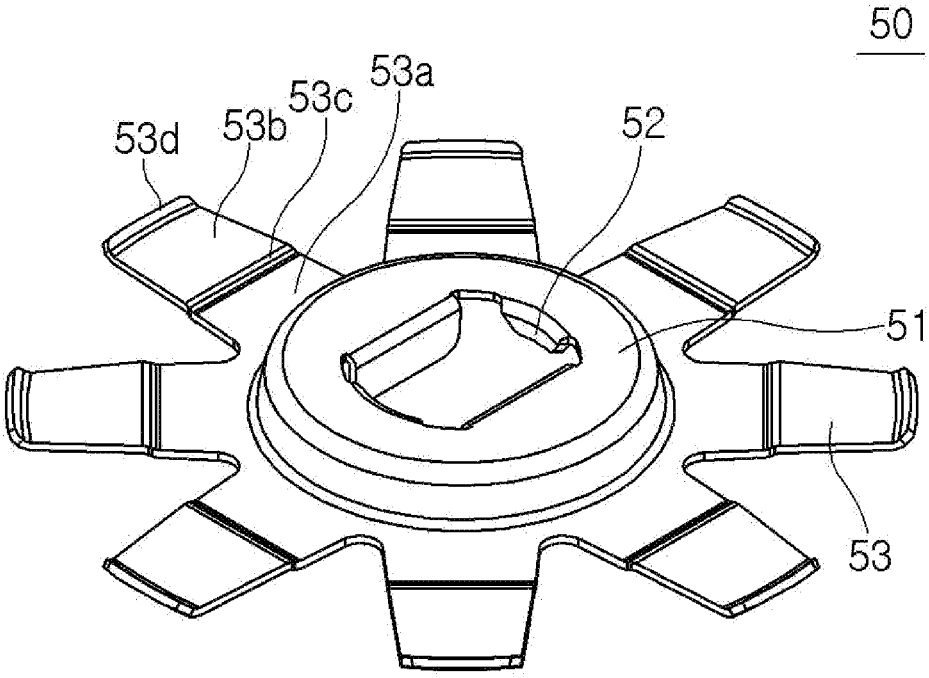
FIG. 8 is a perspective view illustrating a separated structure of a first coupler included in the robot cleaner according to the embodiment of the present disclosure.
Figure 9:
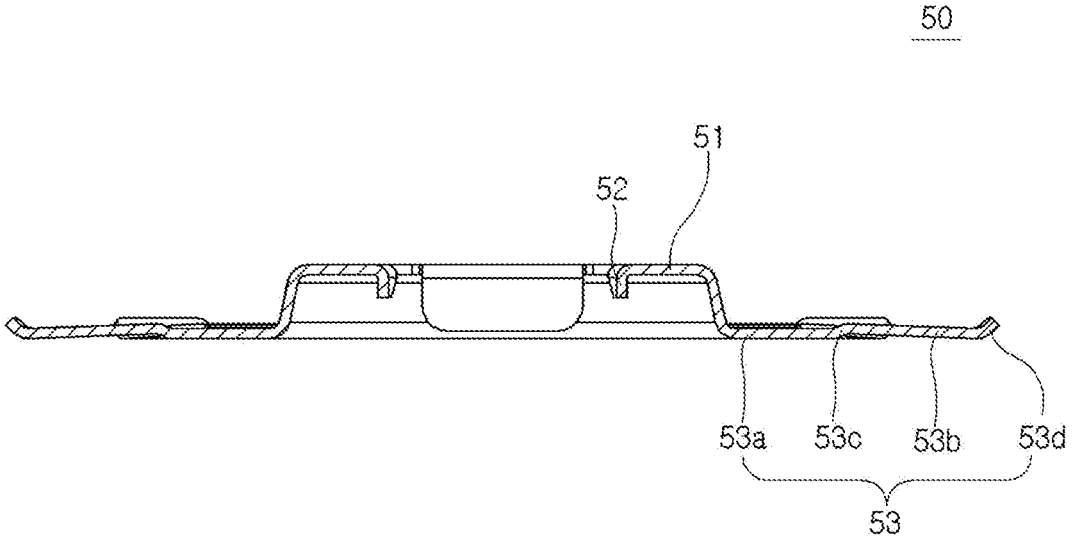
FIG. 9 is a cross-sectional view illustrating the first coupler included in the robot cleaner according to the embodiment of the present disclosure when viewed from one side.
Figure 10:
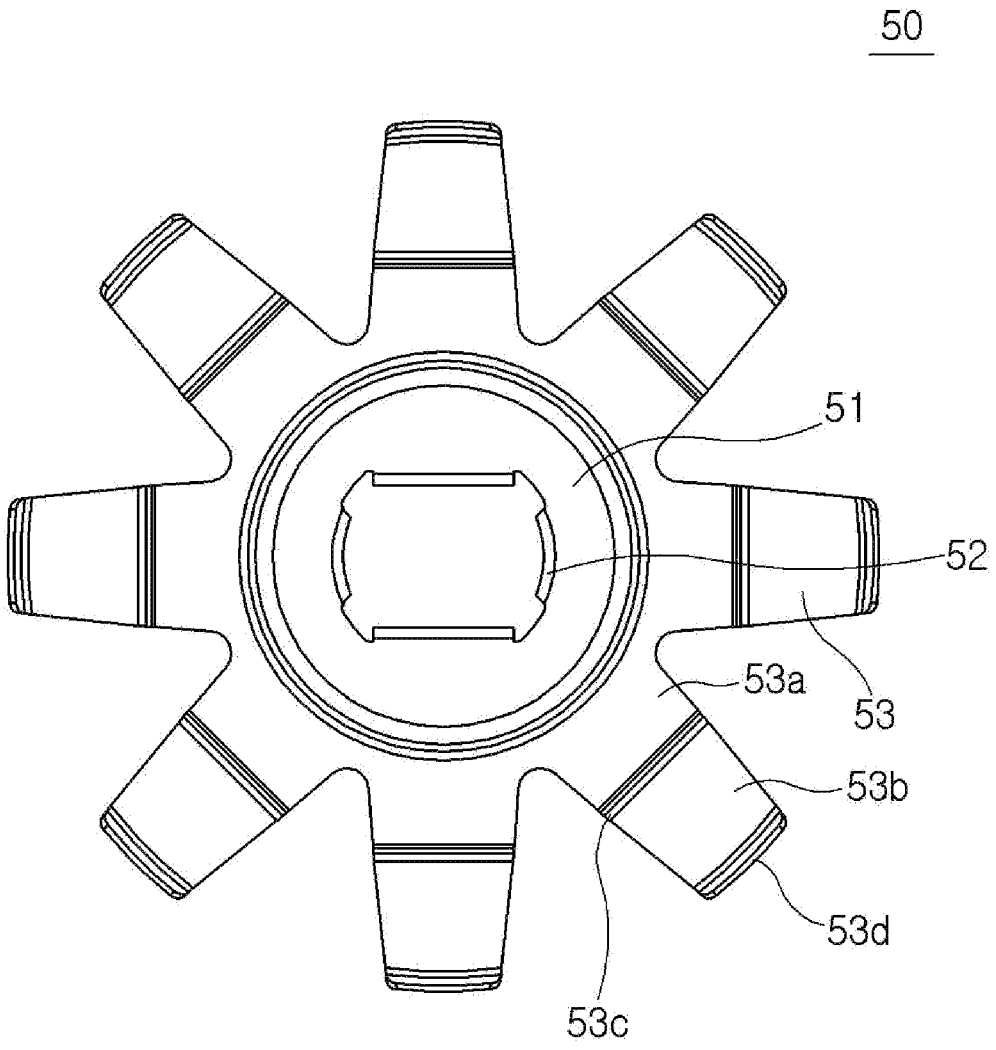
FIG. 10 is a view illustrating the first coupler included in the robot cleaner according to the embodiment of the present disclosure when viewed from above.

FIG. 8 is a perspective view illustrating a separated structure of a first coupler 50 included in the robot cleaner 1 according to the embodiment of the present disclosure, FIG. 9 is a cross-sectional view illustrating the first coupler 50 included in the robot cleaner 1 according to the embodiment of the present disclosure when viewed from one side, and FIG. 10 is a view illustrating the first coupler 50 included in the robot cleaner 1 according to the embodiment of the present disclosure when viewed from above.

Referring to FIGS. 8 to 10, the robot cleaner 1 according to the present disclosure may further include couplers 50 and 60. Hereinafter, the first coupler 50 coupled to an upper portion of the first rotary plate 10 will be described in detail. Like the first coupler 50, the second coupler 60 may be coupled to an upper portion of the second rotary plate 20.

Hereinafter, in the description of the shape of the first coupler 50, the term "upper side" or "upper portion" means a direction of the lower body 100*a*, and the term "lower side" or "lower portion" means a direction of the first mop 30.

The first coupler 50 is disposed on the upper portion of the first rotary plate 10. In more detail, the first coupler 50 may be disposed on an upper portion of the first central plate 11 and coupled by being penetrated by the rotary shaft 15. The first coupler 50 may include a first coupling portion 51 having an internal space corresponding to the shape of the rotary shaft 15 so that the first coupler 50 may be coupled by being penetrated by the rotary shaft 15.

The first coupling portion 51 may have a cylindrical shape. The first coupling portion 51 may have the internal space formed at a center thereof and having a length in a longitudinal direction that is longer than a length in a transverse direction. In addition, as another embodiment, when the shape of the rotary shaft 15 is changed, the shape of the internal space may be changed depending on the shape of the rotary shaft 15. An outer surface of the first coupling portion 51 is formed to surround a ring portion having a predetermined thickness and protruding from a central portion of the first central plate 11.

The first coupler 50 may include first support portions 53 connected to the first coupling portion 51 and extending from an outer circumference of the first coupling portion 51 by a predetermined width.

Referring to FIG. 8, the first support portions 53 may be provided in the form of a plurality of plates radially extending from the outer circumferential surface of the first coupling portion 51. As the number of plates of the first support portions 53 increases, the outer peripheries of the first support portions 53 may become approximately circular. As the number of plates increases, the vacant spaces between the plates are narrowed, which increases the efficiency in dispersing the stress of the first central plate 11.

Referring to FIGS. 8 to 10, the first support portion 53 may include a first support end 53*a*, a second support end 53*b*, a wrinkled portion 53*c*, and a blade portion 53*d*.

In the first support portion 53, the wrinkled portion 53*c*, the second support end 53*b*, and the blade portion 53*d* may be sequentially connected to the first support end 53*a* in the radial direction.

The first support end 53*a* may protrude and extend from the outer circumferential surface of the first coupling portion 51. According to the embodiment in which the first support portions 53 are provided in the form of the plurality of plates, the first support end 53*a* may have a ring-shaped flat plate, and quadrangular flat plates protruding from the outer circumferential surface and disposed at predetermined angles around the central axis.

Figure 15:
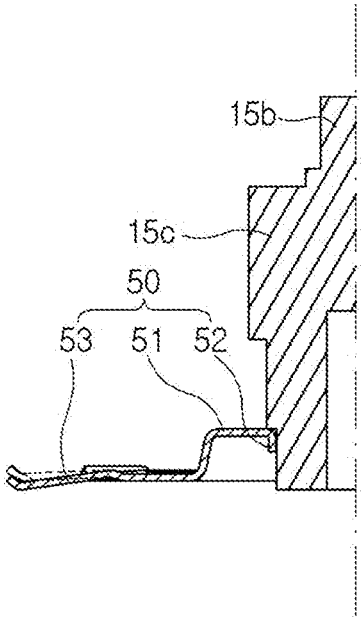
FIGS. 15A and 15B are partial cross-sectional views illustrating states before and after the first coupler and the first rotary plate according to the embodiment of the present disclosure are coupled.
Figure 15:
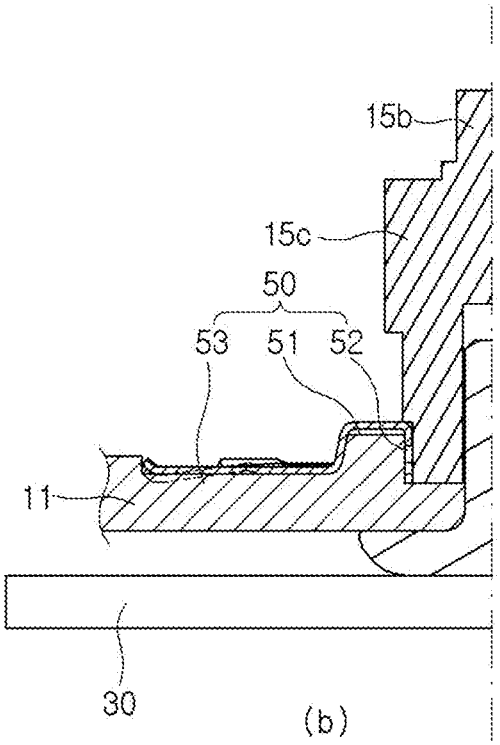

The second support end 53*b* is connected to one end of the first support end 53*a* with a level difference from the first support end 53*a*. The first support end 53*a* and the second support end 53*b* may constitute a cantilevered beam and thus functions as a flat spring. This configuration will be described below in detail with reference to FIG. 15.

The wrinkled portion 53*c* may be disposed between the first support end 53*a* and the second support end 53*b*. The wrinkled portion 53*c* may have two or more stepped portions so that the second support end 53*b* may move as a free end of the cantilevered beam.

An inner end of the second support end 53*b* is fixed, and an outer end of the second support end 53*b* may be rotated by a predetermined angle by pressure applied from below. Therefore, the wrinkled portion 53*c* may have a multi-step structure so that the second support end 53*b* may move.

The blade portion 53*d* may be formed at an outer end of the second support end 53*b*, i.e., an outermost side of the first coupler 50. Referring to FIG. 9, the blade portion 53*d* may be formed to be inclined upward from the second support end 53*b* to support a protruding projection of the central plate 11.

The blade portion 53*d* may be made of metal. Because of the material property, the blade portion 53*d* may provide an elastic force for mitigating stress to be transmitted to the central plate 11. The blade portion 53*d* may be deformed by the projection of the central plate 11 so that an angle of the blade portion 53*d* with respect to the second support end 53*b* becomes close to 90°. The blade portion 53*d* made of metal may have a restoring force for returning the angle of the blade portion 53*d* to the original angle.

A predetermined angle between the blade portion 53*d* and the second support end 53*b* may be set within a range in which a sufficient restoring force may be provided to bring the blade portion 53*d* into stable contact with the projection of the first central plate 11 and to mitigate the stress to be transmitted to the central plate 11.

The angle of the blade portion 53*d* with respect to the second support end 53*b* may be smaller than 90°. Referring to FIG. 3, the stress directed toward the center of the first coupler 50 from the first central plate 11 is applied to a contact point at which the first rotary plate 10, together with the first mop 30, is in contact with the ground surface. Therefore, the stress is determined by torque (T=F×R) generated by a distance R from the center of the first rotary plate 10 and a force F applied from the ground surface. Because the elastic force for mitigating the stress is more effective than a rotational elastic force directed toward the ground surface, the angle of the blade portion 53*d* with respect to the second support end 53*b* may be smaller than 90°.

The first coupler 50 may further include a first close-contact portion 52 extending, by a predetermined length, toward a lower end thereof, i.e., toward the ground surface from an inner end that defines the internal space of the first coupling portion 51. The first close-contact portion 52 may come into surface contact with an outer circumferential surface of the rotary shaft 15 and prevent the rotary shaft 15 from swaying.

Typically, there are many obstacles such as foreign substances or doorsills on the ground surface on which the robot cleaner 1 moves, and the robot cleaner 1 passes over the obstacles in accordance with the functional properties of the robot cleaner 1. When the robot cleaner 1 passes over the obstacle, the irregular swaying of the body 100 may be transmitted to the rotary shaft 15. The swaying applied to the rotary shaft 15 may act as stress that damages the first central plate 11 in contact with and coupled to the rotary shaft 15. Therefore, the embodiment of the present disclosure includes the first close-contact portion 52 provided in the internal space coupled to the rotary shaft 15 of the first coupler 50, thereby minimizing the swaying to be transmitted to the rotary shaft 15.

The first close-contact portion 52 may correspond to the shape of the rotary shaft 15. The first close-contact portion 52 is disposed in the internal space of the first coupling portion 51. Since the internal space of the first coupling portion 51 corresponds to the shape of the rotary shaft 15, and the shape of the first close-contact portion 52 may correspond to the shape of the rotary shaft 15. Therefore, when the rotary shaft 15 has a cylindrical shape, the first close-contact portion 52 may have a curved surface with a predetermined height to correspond to the shape of the rotary shaft 15. When the rotary shaft 15 includes a flat surface, the first close-contact portion 52 may have a flat plate shape to correspond to the shape of the rotary shaft 15. In addition, referring to the embodiment illustrated in FIG. 10, the first close-contact portion 52 may have a flat plate shape in a longitudinal direction and a curved surface in a transverse direction.

Referring to FIG. 8, the first close-contact portion 52 may include a plurality of flat springs extending downward. The first close-contact portion 52 may prevent the rotary shaft 15 and the first central plate 11 from coming into direct contact with each other. In addition, the first close-contact portion 52 may be made of metal having elasticity to reduce the swaying of the rotary shaft 15, and thus the first close-contact portion 52 may function as a flat spring. Therefore, when the first close-contact portion 52 is deformed toward the first central plate 11 by the swaying of the rotary shaft 15, the restoring force may be generated to return the first close-contact portion 52 to the original state. Therefore, the stress of the rotary shaft 15 may be offset by the restoring force of the first close-contact portion 52, thereby preventing damage to the first central plate 11.

The plurality of flat springs of first close-contact portion 52 may be spaced apart from one another at predetermined intervals. The first close-contact portion 52 may be in close contact with the rotary shaft 15 in at least four directions to provide the restoring force correspond to the irregular swaying of the rotary shaft 15. Therefore, the first close-contact portion 52 may include at least four flat springs. In addition, since the first close-contact portion 52 includes the plurality of flat springs, it is possible to prevent the damage even though the rotary shaft 15 strongly sways in one direction.

In the case in which the first close-contact portion 52 includes the plurality of flat springs, the plurality of flat springs may be spaced apart from one another at predetermined intervals. The flat springs generate the restoring force for returning the rotary shaft to the original state when the flat springs move by a predetermined angle by the swaying of the rotary shaft 15. Therefore, the flat springs may be disposed at predetermined intervals, such that the flat springs are prevented from coming into contact with one another, thereby preventing the movements of the flat springs from being hindered.

Figure 11:
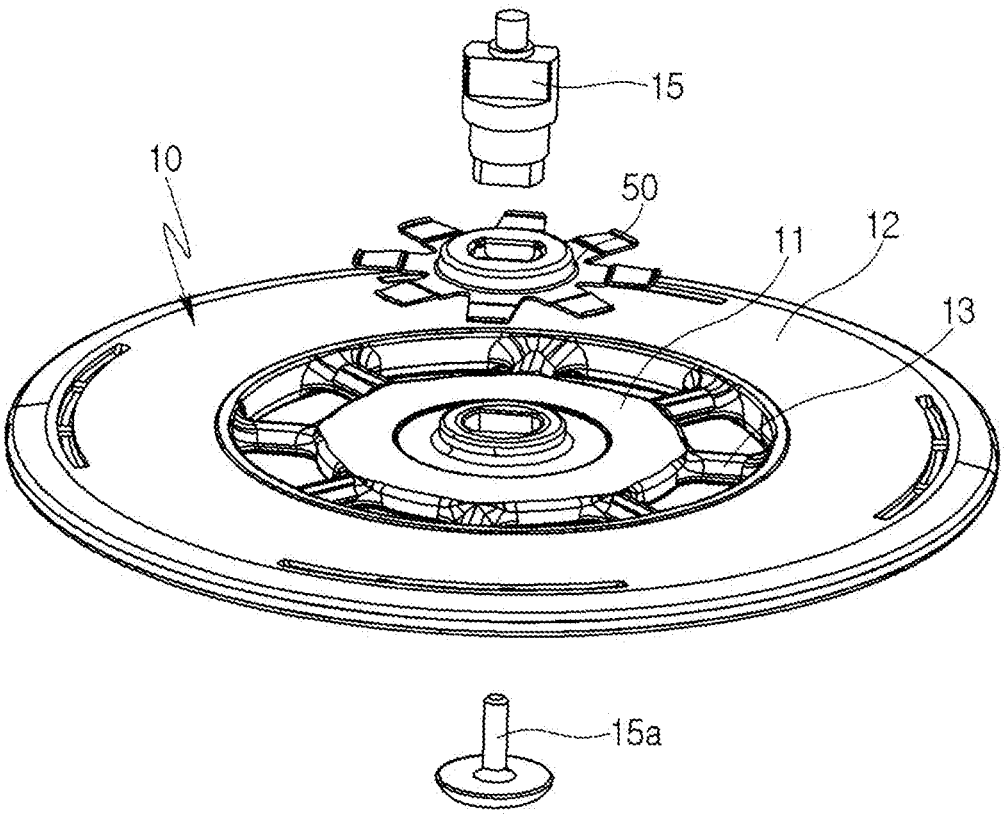
FIG. 11 is an exploded perspective view illustrating a separated structure in which a first rotary plate and the first coupler according to the embodiment of the present disclosure are coupled.
Figure 12:
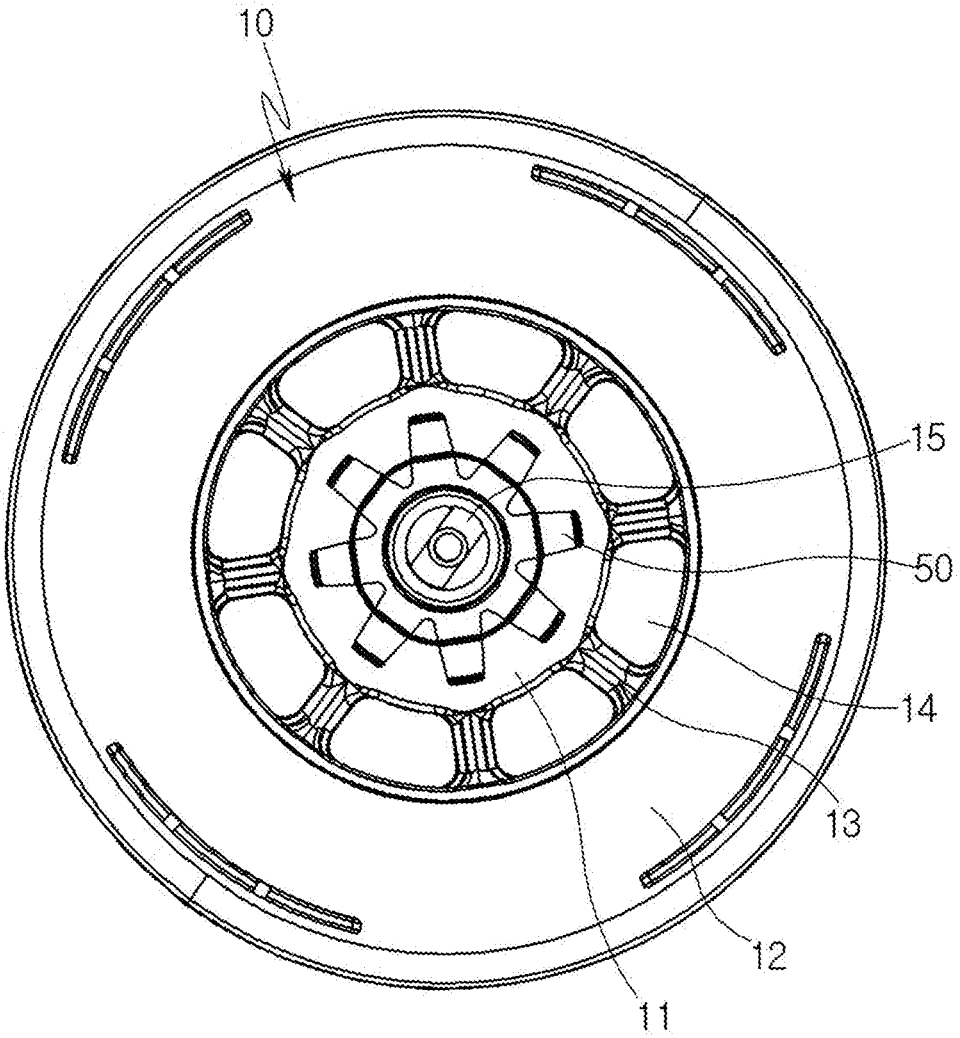
FIG. 12 is a view illustrating a structure in which the first rotary plate and the first coupler according to the embodiment of the present disclosure are coupled when viewed from above.
Figure 13:
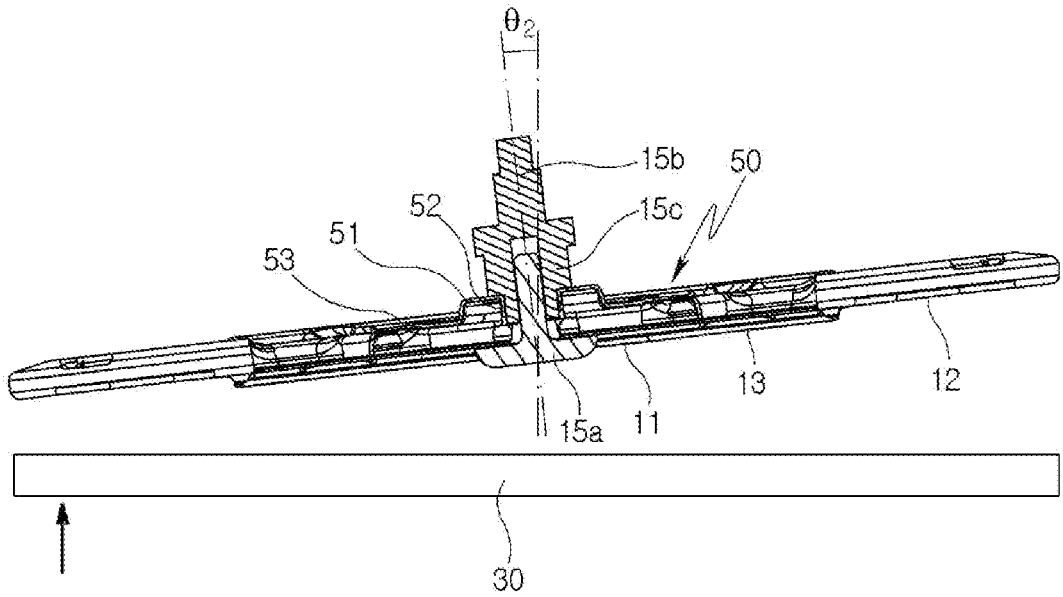
FIG. 13 is a cross-sectional view illustrating a structure in which the first rotary plate, the first coupler, and a first mop according to the embodiment of the present disclosure are coupled when viewed from one side.

FIG. 11 is an exploded perspective view illustrating a separated structure in which the first rotary plate 10 and the first coupler 50 according to the embodiment of the present disclosure are coupled, FIG. 12 is a view illustrating a structure in which the first rotary plate 10 and the first coupler 50 according to the embodiment of the present disclosure are coupled when viewed from above, and FIG. 13 is a cross-sectional view illustrating a structure in which the first rotary plate 10, the first coupler 50, and the first mop 30 according to the embodiment of the present disclosure are coupled when viewed from one side.

Referring to FIG. 11, the first rotary plate 10 and the first coupler 50 may be coupled to each other. In the step of coupling the first rotary plate 10, the first central plate 11, the first spokes 13, and the first outer peripheral plate 12 are coupled, and then the rotary shaft 15 may be penetratively coupled to the first coupler 50 with the first central plate 11 interposed therebetween. In more detail, the rotary shaft 15 may include a coupling pin 15*a*, a shaft driving portion 15*b*, and a shaft body 15*c* (see FIG. 13), and the first central plate 11 may be fixedly coupled and disposed between the shaft body 15*c* and the coupling pin 15*a*.

The first coupler 50 may be disposed on the upper portion of the first central plate 11 and fixedly coupled and disposed, together with the first central plate 11, between the shaft body 15*c* and the coupling pin 15*a*. Therefore, according to the coupling sequence. after the first central plate 11, the first spokes 13, and the first outer peripheral plate 12 are coupled, the first central plate 11 is covered by the first coupler 50, and then the rotary shaft 15 may be coupled while penetrating the first central plate 11 and the first coupler 50.

Referring to FIG. 12, the first coupler 50 may extend radially to correspond to the number of first spokes 13. The stress, which is generated when the first rotary plate 10 comes into contact with the floor surface, may be transmitted in the direction toward the center from the portion where the first rotary plate 10 comes into contact with the floor surface (see FIG. 3). Therefore, the stress may be transmitted to the first central plate 11 from one side of the first outer peripheral plate 12 through any one of the first spokes 13. In order to disperse the transmitted stress, the first coupler 50 extends to correspond to the first spokes 13, and a direction of the first coupler 50 and a direction of the first spokes 13 are coincident with each other so as to be positioned on the same imaginary line, thereby improving the efficiency in receiving the stress.

According to the embodiment illustrated in FIG. 12, the first support portions 53 of the first coupler 50 may be provided in the form of a plurality of flat plates each having a width that decreases outward in the radial direction.

The plurality of first spokes 13 are radially disposed along the outer circumferential surface of the first central plate 11. The water may be delivered from the water container 230 to the first mop 30 disposed below the water container 230 through the holes 14 present between the first spokes 13. Therefore, the plurality of first spokes 13 may have a minimum width to smoothly supply the water to the first mop 30.

An end of the first support portion 53, which is close to the first spoke 13, may have a width corresponding to a width of the first spoke 13 to improve the efficiency in receiving the stress. Further, in order to disperse the stress transmitted to the first central plate 11 from the rotary shaft 15, the radial flat plates of the first support portions 53, which are close to the rotary shaft 15, may be connected to each other to define an approximately circular shape. Therefore, the first support portions 53 may be provided in the form of the plurality of flat plates each having a width that increases inward in the radial direction.

Referring to FIG. 13, the rotary shaft 15*b* may be disposed to be inclined at a predetermined angle $\theta_2$ with respect to the direction perpendicular to the first mop 30. As described above, the rotary shaft 15*b* is disposed at a predetermined angle $\theta_2$ with respect to the direction perpendicular to the ground surface to move forward and rearward. Therefore, the first central plate 11, the first outer peripheral plate 12, the first spokes 13, and the first coupler 50, which are coupled by the rotary shaft, may be disposed at the predetermined angle $\theta_2$ with respect to the direction perpendicular to the ground surface.

According to the embodiment of the present disclosure, the predetermined angle $\theta_2$ of the first rotary plate 10 continuously generates the stress at the position at which the first rotary plate 10 comes into contact with the ground surface. The generated stress is transmitted in the direction toward the center of the first rotary plate 10 and causes damage. Therefore, the first coupler 50 may solve the above-mentioned problem by dispersing the stress.

Figure 14:
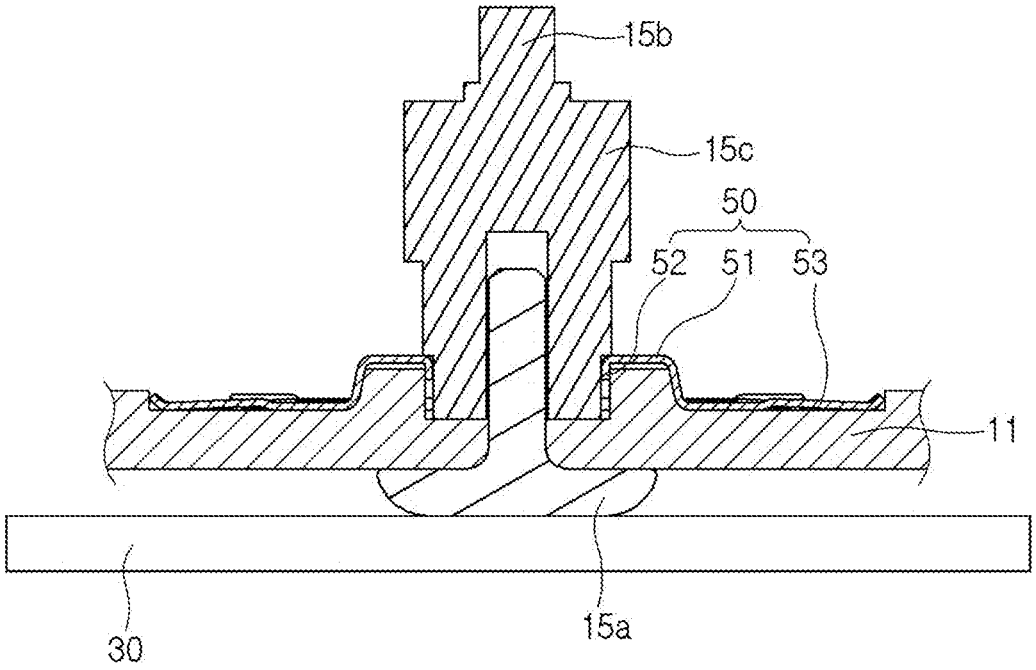
FIG. 14 is a partial cross-sectional view illustrating an enlarged part in which the first rotary plate and the first coupler according to the embodiment of the present disclosure are coupled.

FIG. 14 is a partial cross-sectional view illustrating an enlarged part in which the first rotary plate 10 and the first coupler 50 according to the embodiment of the present disclosure are coupled, and FIGS. 15A and 15B are partial cross-sectional views illustrating states before and after the first coupler 50 and the first rotary plate 10 according to the embodiment of the present disclosure are coupled.

Referring to FIG. 14, the blade portions 53*d* of the first coupler 50 are in contact with and support the protruding projection of the first central plate 11. The first central plate 11 has the central portion having the internal space to which the rotary shaft 15 may be coupled. The first central plate 11 may have a coupling portion having a predetermined height, and two stepped portions extending by a predetermined width along the outer circumference of the coupling portion (see FIG. 11). The blade portions 53*d* of the first coupler 50 may be in contact with the projection between the two stepped portions of the first central plate 11.

The first coupler 50 supports the first central plate 11 through the blade portions 53*d*. As described above, the movement of the first central plate 11 may be prevented by the elastic force.

The first coupling portion 51 and the first close-contact portion 52 of the first coupler 50 may define a predetermined space into which the coupling portion of the first central plate 11 may be fitted. Referring to FIG. 14, an end of the first close-contact portion 52 may be spaced apart from the first central plate 11 at a predetermined interval. That is, a length of the first close-contact portion 52 may be smaller than a height of the coupling portion of the first central plate 11. Therefore, a part of the coupling portion of the first central plate 11 is not in direct contact with the first close-contact portion 52 and may not receive the stress from the rotary shaft 15.

Referring to FIGS. 15A and 15B, the shape of the first support portion 53 of the first coupler 50 may be changed depending on the states before and after the first coupler 50 is coupled to the rotary shaft 15 and the first central plate 11.

In more detail, the first support portion 53 includes the wrinkled portion 53*c* which is flexibly deformable in shape vertically, and the blade portion 53*d* formed upward at a predetermined angle at the outer peripheral end of the first support portion 53. The blade portion 53*d* is disposed upward at a predetermined angle so as to have the highest load per unit length of the first support portion 53. Therefore, the first support portion 53 has a high load at the outer periphery at which the blade portion 53*d*, and the wrinkled portion 53*c* may move vertically and be inclined downward by its own weight before the first coupler is coupled to the rotary shaft 15 and the first central plate 11 (see FIG. 15A).

In the embodiment illustrated in FIG. 15B, the state in which the first coupler 50 is coupled to the first central plate 11 and the rotary shaft 15 is illustrated. The second support ends 53*b* of the first support portions 53 may be supported by and in close contact with the first central plate 11 to define a flat plate shape.

In more detail, the second support ends 53*b* of the first support portions 53 may be supported by the first central plate 11. The coupling force between the first central plate 11 and the rotary shaft 15 may be higher than the weights of the second support ends 53*b* and the weights of the blade portions 53*d*, thereby moving the second support ends 53*b* upward. Therefore, the first support portions 53 may be deformed in a flat plate shape and be in close contact with the first central plate 11.

As described above, the first support portion 53 is configured such that the shape thereof may be deformed depending on the states before and after the first coupler is coupled to the rotary shaft 15 and the first central plate 11. Therefore, the first support portions 53 may be in close contact with the first central plate 11.

In addition, when the first central plate 11 moves vertically, the second support ends 53*b* may move vertically to correspond to the vertical movement of the first central plate 11, thereby maintaining the contact between the first central plate 11 and the first support portions 53.

Further, the wrinkled portions 53*c* may generate the rotational elastic force for the restoration to the initial shape, such that the second support ends 53*b* may prevent the vertical movement of the first central plate 11.

Because the second coupler 60 and the first coupler 50 are identical in structure and function to each other, the description of the second coupler 60 may be replaced with the description of the first coupler 50.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

DESCRIPTION OF REFERENCE NUMERALS

1: Robot cleaner
10: First rotary plate
11: First central plate
12: Second outer peripheral plate
13: First spoke
15: Rotary shaft
15*a*: Coupling pin
20: Second rotary plate
21: Second central plate
22: Second outer peripheral plate
23: Second spoke
25: Rotary shaft
30: First mop
40: Second mop
50: First coupler
51: Coupling portion
52: Close-contact portion
53: Support portion
53*a*: First support end
53*b*: Second support end
53*c*: Wrinkled portion
54*d*: Blade portion
60: Second coupler
100: Body
120: First support wheel
130: Second support wheel
140: Auxiliary wheel
150: Auxiliary wheel body
160: First actuator
170: Second actuator
180: Control part
190: Bumper
200: First sensor
210: Second sensor
220: Battery
230: Water container

The invention claimed is:

1. A robot cleaner comprising:
a body configured to define an external appearance, and including a drive motor;
a rotary plate to be rotatably coupled to the body, and the rotary plate having a lower portion to which a mop is to be coupled; and
a coupler to couple between the body and the rotary plate,
wherein the rotary plate includes:
a central plate;
a plurality of spokes to couple to an outer circumferential surface of the central plate, each of the spokes to separately extend in a radial direction from the circumferential surface of the central plate;
an outer peripheral plate to connect to the plurality of spokes and to radially extend by a predetermined width; and
a rotary shaft configured to rotate the central plate, and
wherein the coupler includes:
a coupling portion having a space to be penetrated by the rotary shaft;
a plurality of support portions to couple to an outer circumferential surface of the coupling portion, each of the support portions to separately extend outward from the outer circumferential surface of the coupling portion; and
a close-contact portion to extend from the space of the coupling portion and to have surface contact with the rotary shaft, and the close-contact portion made of metal has elasticity to reduce swaying of the rotary shaft.

2. The robot cleaner of claim 1, wherein the support portions are configured to extend radially and be radially aligned with the spokes.

3. The robot cleaner of claim 2, wherein the support portion comprises:
a first support end to extend from the outer circumferential surface of the coupling portion, and the first support end to contact an upper portion of the central plate; and
a second support end to couple to an outer end of the first support end, and
wherein the second support end is disposed to have a level difference from the first support end.

4. The robot cleaner of claim 3, wherein the support portion comprises a blade portion to extend from an outer end of the second support end, and
wherein the blade portion is to be inclined upward from the second support end and is configured to support a protruding projection of the central plate.

5. The robot cleaner of claim 3, wherein the second support end is inclined downward from the first support end.

6. The robot cleaner of claim 2, wherein the support portions include a plurality of flat plates each having a width that decreases outward in the radial direction from the coupling portion.

7. The robot cleaner of claim 1, wherein the coupler includes a close-contact portion to extend downward from an inner end of the coupling portion.

8. The robot cleaner of claim 7, wherein the close-contact portion is configured to be in surface contact with an outer surface of the rotary shaft.

9. The robot cleaner of claim 8, wherein the close-contact portion includes a plurality of flat springs to extend downward from the inner end of the coupling portion.

10. The robot cleaner of claim 9, wherein the plurality of flat springs are spaced apart from each other.

11. The robot cleaner of claim 4, wherein the blade portion is made of a metal, and the blade portion is configured to provide an elastic force for mitigating stress to be provided to the central plate.

12. A robot cleaner comprising:
a body;
a rotary shaft;
a rotary plate to couple to the rotary shaft so as to be rotated, and the rotary plate configured to support a mop for cleaning; and
a coupler to couple to the rotary plate,
wherein the rotary plate includes:
a central plate;
an outer plate spaced apart from an outer surface of the central plate; and
a plurality of spokes to connect the outer surface of the central plate to the outer plate, each of the spokes to separately radially extend from the outer surface of the central plate to the outer plate;
wherein the rotary shaft is configured to rotate the central plate, and
wherein the coupler includes:
a coupling portion having an inner space in which the rotary shaft is to be provided; and a plurality of support portions to couple to an outer surface of the coupling portion, each of the support portions to separately extend outward from the outer surface of the coupling portion, wherein an outer end of one of the support portions is to be inclined upward to support a protrusion of the central plate.

13. The robot cleaner of claim 12, wherein each of the support portions comprises:

a first support part to couple to the outer surface of the coupling portion;

a second support part to couple to an outer end of the first support part; and a blade portion to be inclined upward from an outer end of the second support part.

14. The robot cleaner of claim 13, wherein the support portions include a plurality of flat plates each having a width that decreases outward in a radial direction.

15. The robot cleaner of claim 12, wherein the coupler includes a close-contact portion to extend from the inner space of the coupling portion and to have surface contact with the rotary shaft, and configured to reduce swaying of the rotary shaft.

16. The robot cleaner of claim 15, wherein the close-contact portion includes a plurality of flat springs to separately extend downward from the inner space of the coupling portion and to provide a restoring force for the rotary shaft.

17. The robot cleaner of claim 13, wherein the blade portion is made of a metal, and the blade portion is configured to provide an elastic force for mitigating stress to be provided to the central plate.

18. A robot cleaner comprising:

a body;

a rotary shaft configured to rotate;

a rotary plate configured to rotate with respect to the body based on the rotary shaft; and a coupler to couple to the rotary plate, wherein the rotary plate includes a central plate, an outer plate, and a plurality of spokes each to couple to an outer surface of the central plate and to the outer plate;

wherein the coupler includes:

a coupling portion having an inner space in which the rotary shaft is to pass;

a plurality of support portions to couple to the coupling portion and to separately extend outward from the coupling portion such that each of the support portions is to be radially aligned with a corresponding one of the spokes; and wherein the coupler includes a close-contact portion to extend from the inner space of the coupling portion and to have surface contact with the rotary shaft, and the close-contact portion made of metal has elasticity to reduce swaying of the rotary shaft.

19. The robot cleaner of claim 18, wherein each of the support portions comprises:

a first support part to couple to the coupling portion;

a second support part to couple to an outer end of the first support part; and a blade portion to be inclined upward from an outer end of the second support part, and configured to support a protrusion of the central plate.

* * * * *